US008781308B2

(12) United States Patent
Harumoto

(10) Patent No.: US 8,781,308 B2
(45) Date of Patent: Jul. 15, 2014

(54) APPARATUS FOR AND METHOD OF HEAT-TREATING FILM FORMED ON SURFACE OF SUBSTRATE

(75) Inventor: Masahiko Harumoto, Kyoto (JP)

(73) Assignee: Sokudo Co., Ltd. (JP)

( * ) Notice: Subject to any disclaimer, the term of this patent is extended or adjusted under 35 U.S.C. 154(b) by 349 days.

(21) Appl. No.: 13/239,517

(22) Filed: Sep. 22, 2011

(65) Prior Publication Data

US 2012/0213501 A1 Aug. 23, 2012

(30) Foreign Application Priority Data

Feb. 21, 2011 (JP) ..... 2011-034146

(51) Int. Cl.

| | |
|---|---|
| ***F27B 5/06*** | (2006.01) |
| ***F27B 5/14*** | (2006.01) |
| ***F27D 9/00*** | (2006.01) |
| ***F27D 11/02*** | (2006.01) |

(52) U.S. Cl.

USPC ..... 392/416; 392/418; 219/399; 219/411; 118/724; 118/725; 165/61

(58) Field of Classification Search

None

See application file for complete search history.

(56) References Cited

U.S. PATENT DOCUMENTS

| | | | | | |
|---|---|---|---|---|---|
| 4,816,638 | A | * | 3/1989 | Ukai et al. | 219/121.43 |
| 4,854,263 | A | * | 8/1989 | Chang et al. | 118/715 |
| 5,314,541 | A | * | 5/1994 | Saito et al. | 118/725 |
| 5,374,594 | A | * | 12/1994 | van de Ven et al. | 438/758 |
| 5,377,425 | A | * | 1/1995 | Kawakami et al. | 34/92 |
| 5,478,429 | A | * | 12/1995 | Komino et al. | 156/345.44 |
| 5,665,167 | A | * | 9/1997 | Deguchi et al. | 118/728 |
| 5,716,207 | A | * | 2/1998 | Mishina et al. | 432/253 |
| 5,884,009 | A | * | 3/1999 | Okase | 392/418 |
| 6,004,047 | A | * | 12/1999 | Akimoto et al. | 396/604 |
| 6,062,852 | A | * | 5/2000 | Kawamoto et al. | 432/258 |
| 6,357,143 | B2 | * | 3/2002 | Morad et al. | 34/412 |
| 6,561,796 | B1 | * | 5/2003 | Barrera et al. | 432/5 |
| 6,578,287 | B2 | * | 6/2003 | Aswad | 34/367 |
| 6,593,253 | B1 | * | 7/2003 | Shiokawa | 438/787 |
| 6,725,565 | B2 | * | 4/2004 | Harano et al. | 34/266 |
| 6,783,630 | B2 | * | 8/2004 | Shajii et al. | 156/345.53 |
| 6,796,795 | B2 | * | 9/2004 | Inaba et al. | 432/5 |
| 6,897,411 | B2 | * | 5/2005 | Beer et al. | 219/390 |
| 6,929,774 | B2 | * | 8/2005 | Morad et al. | 266/81 |
| 6,998,580 | B2 | | 2/2006 | Kusuda et al. | |

(Continued)

FOREIGN PATENT DOCUMENTS

| | | | |
|---|---|---|---|
| JP | 63-202025 | | 8/1988 |
| JP | 2001196363 | A * | 7/2001 |
| JP | 2001-332484 | | 11/2001 |

*Primary Examiner* — Joseph M Pelham

(74) *Attorney, Agent, or Firm* — Ostrolenk Faber LLP

(57) ABSTRACT

The back surface of a substrate having a front surface coated with a resist film is irradiated with flashes of light emitted from flash lamps. Heat conduction from the back surface of the substrate abruptly raised in temperature by the irradiation with flashes of light toward the front surface thereof occurs to heat the resist film formed on the front surface of the substrate, so that a post-applied bake process is performed. After the completion of the post-applied bake process, a cooling plate cools down the substrate. Regardless of the type of resist film formed on the front surface of the substrate, the substrate has a constant absorptance of flashes of light to allow the resist film to be heated to a constant treatment temperature, because the back surface of the substrate is irradiated with flashes of light.

8 Claims, 12 Drawing Sheets

(56) References Cited

U.S. PATENT DOCUMENTS

| | | | | |
|---|---|---|---|---|
| 7,166,187 | B2 * | 1/2007 | Shajii et al. | 156/345.53 |
| 7,192,494 | B2 * | 3/2007 | Chen et al. | 148/518 |
| 7,311,810 | B2 * | 12/2007 | Mok et al. | 204/242 |
| 7,431,967 | B2 * | 10/2008 | Yuan et al. | 427/255.28 |
| 7,442,900 | B2 * | 10/2008 | Inagawa et al. | 219/390 |
| 7,456,116 | B2 * | 11/2008 | Ingle et al. | 438/787 |
| 7,642,171 | B2 * | 1/2010 | Ingle et al. | 438/424 |
| 7,651,583 | B2 * | 1/2010 | Kent et al. | 156/345.31 |
| 7,674,727 | B2 * | 3/2010 | Yuan et al. | 438/787 |
| 7,780,438 | B2 * | 8/2010 | Hayashi et al. | 432/81 |
| 7,797,855 | B2 * | 9/2010 | Fukuoka et al. | 34/78 |
| 7,867,403 | B2 * | 1/2011 | Plumhoff et al. | 216/12 |
| 7,927,657 | B2 * | 4/2011 | Kobayashi et al. | 427/240 |
| 8,221,835 | B2 * | 7/2012 | Noda et al. | 427/248.1 |
| 8,227,030 | B2 * | 7/2012 | Noda et al. | 427/248.1 |
| 8,409,399 | B2 * | 4/2013 | LaFlamme et al. | 156/345.37 |
| 2009/0060686 | A1 | 3/2009 | Morita et al. | 414/147 |

* cited by examiner

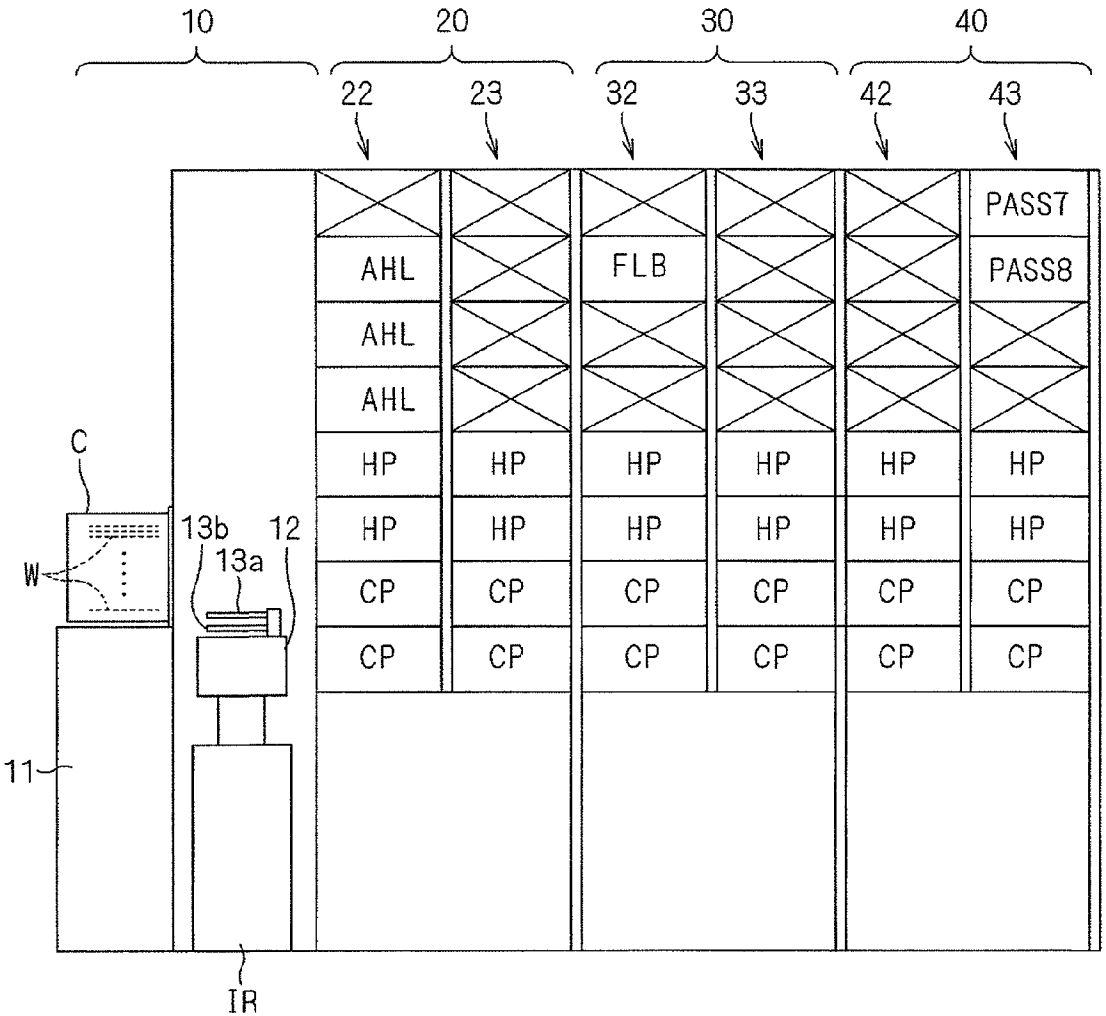
FIG. 3
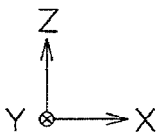

APPARATUS FOR AND METHOD OF HEAT-TREATING FILM FORMED ON SURFACE OF SUBSTRATE

BACKGROUND OF THE INVENTION

1. Field of the Invention

The present invention relates to a heat treatment apparatus and a heat treatment method for heat-treating a thin plate-like precision electronic substrate, such as a semiconductor wafer and a glass substrate for a liquid crystal display device (hereinafter referred to simply as a "substrate"), which has a surface coated with a film such as a resist film.

2. Description of the Background Art

Products of semiconductor devices, liquid crystal display devices and the like are fabricated by performing a series of processes including cleaning, resist coating, exposure, development, etching, interlayer insulation film formation, heat treatment, dicing and the like on the aforementioned substrate. A substrate processing apparatus which performs, among the aforementioned processes, a resist coating process on a substrate to transfer the substrate to an exposure unit and which receives an exposed substrate from the exposure unit to perform a development process on the exposed substrate is widely used as what is called a coater-and-developer. U.S. Patent Application Publication No. 2009/060686 discloses an example of such a substrate processing apparatus.

As disclosed also in U.S. Patent Application Publication No. 2009/060686, a coater-and-developer performs a post-applied bake (PAB) process for performing a heating treatment on a substrate with a resist film formed thereon by a resist coating process to evaporate a solvent component in the resist. When a chemically amplified resist is used, the coater-and-developer performs a post-exposure bake (PEB) process on an exposed substrate to cause a reaction such as crosslinking, deprotection or decomposition and the like of resist resin to proceed using a product formed in a resist film by a photochemical reaction during the exposure process as an acid catalyst. After a development process, the coater-and-developer performs a hard bake (HB) process for heating a substrate to completely dry a patterned resist film. In this manner, the coater-and-developer performs heating treatments on films formed on a surface of a substrate for various purposes.

An attempt has also been made to perform such heating treatments of films by light-irradiation heating. For example, Japanese Patent Application Laid-Open No. 63-202025 (1988) discloses that a heating treatment is performed by irradiating a resist film formed by spin coating on a main surface of a substrate with infrared light. Also, Japanese Patent Application Laid-Open No. 2001-332484 discloses that a resist pattern subjected to a development process is irradiated with light from a flash lamp.

However, heating treatments performed on resist films formed on main surfaces of substrates by irradiation with light result in different heating treatment temperatures in some cases even when the resist films are irradiated with light at the same intensity because optical absorption characteristics differ depending on the types of resist films and resist patterns. As a result, there arises a problem such that process uniformity cannot be maintained between substrates. It is also very complicated to change the intensity of light for irradiation in accordance with the types of resist films and the like.

SUMMARY OF THE INVENTION

The present invention is intended for a heat treatment apparatus for heat-treating a substrate having a film-coated surface.

According to one aspect of the present invention, the heat treatment apparatus comprises: a chamber for receiving therein a substrate, the substrate having a front surface coated with a predetermined film and a back surface; a holding part for holding the substrate in the chamber; and a flash lamp for irradiating the back surface of the substrate held by the holding part with a flash of light.

The back surface of the substrate having the front surface coated with the predetermined film is irradiated with a flash of light. Thus, regardless of the type of film formed on the front surface of the substrate, the substrate has a constant absorptance of a flash of light to allow the predetermined film to be heated to a constant treatment temperature.

Preferably, the heat treatment apparatus further comprises a cooling plate disposed in proximity to the front surface of the substrate held by the holding part and configured to cool down the substrate.

This provides temperature history uniformity between substrates.

Preferably, the heat treatment apparatus further comprises a black body plate provided between the substrate held by the holding part and the flash lamp.

The substrate is heated indirectly through the black body plate raised in temperature by the irradiation with a flash of light. Thus, regardless of the type of film formed on the front surface of the substrate, the predetermined film is heated to a constant treatment temperature.

The present invention is also intended for a method of heat-treating a substrate having a film-coated surface.

According to one aspect of the present invention, the method comprises the steps of: (a) putting a substrate into a chamber to hold the substrate, the substrate having a front surface coated with a predetermined film and a back surface; and (b) irradiating the back surface of the substrate held in the chamber with a flash of light emitted from a flash lamp to heat the predetermined film.

The back surface of the substrate having the front surface coated with the predetermined film is irradiated with a flash of light, whereby the predetermined film is heated. Thus, regardless of the type of film formed on the front surface of the substrate, the substrate has a constant absorptance of a flash of light to allow the predetermined film to be heated to a constant treatment temperature.

Preferably, the back surface of the substrate is irradiated with a flash of light while the substrate is cooled by a cooling plate disposed in proximity to the front surface of the substrate.

This provides temperature history uniformity between substrates.

Preferably, a flash of light is directed onto a black body plate provided between the substrate and the flash lamp to raise the temperature of the black body plate, whereby the substrate is heated by thermal radiation from the black body plate raised in temperature.

Regardless of the type of film formed on the front surface of the substrate, the film is heated to a constant treatment temperature.

Preferably, a time period for heating treatment by the irradiation with a flash of light in the step (b) is not greater than one second.

The time period for heating treatment is short so that throughput is improved.

Preferably, a voltage applied to the flash lamp is controlled, whereby a treatment temperature for the predetermined film is changed in the step (b).

The treatment temperature for the predetermined film is changed by controlling the voltage applied to the flash lamp. This eliminates the need for waiting time required for treatment temperature changes.

It is therefore an object of the present invention to heat a film formed on a surface of a substrate to a constant treatment temperature regardless of the type of film.

These and other objects, features, aspects and advantages of the present invention will become more apparent from the following detailed description of the present invention when taken in conjunction with the accompanying drawings.

BRIEF DESCRIPTION OF THE DRAWINGS

FIG. 3 is a front view of a heat treatment part in the substrate processing apparatus of FIG. 1;

DESCRIPTION OF THE PREFERRED EMBODIMENTS

Preferred embodiments according to the present invention will now be described in detail with reference to the drawings.

<First Preferred Embodiment>

Figure 1:
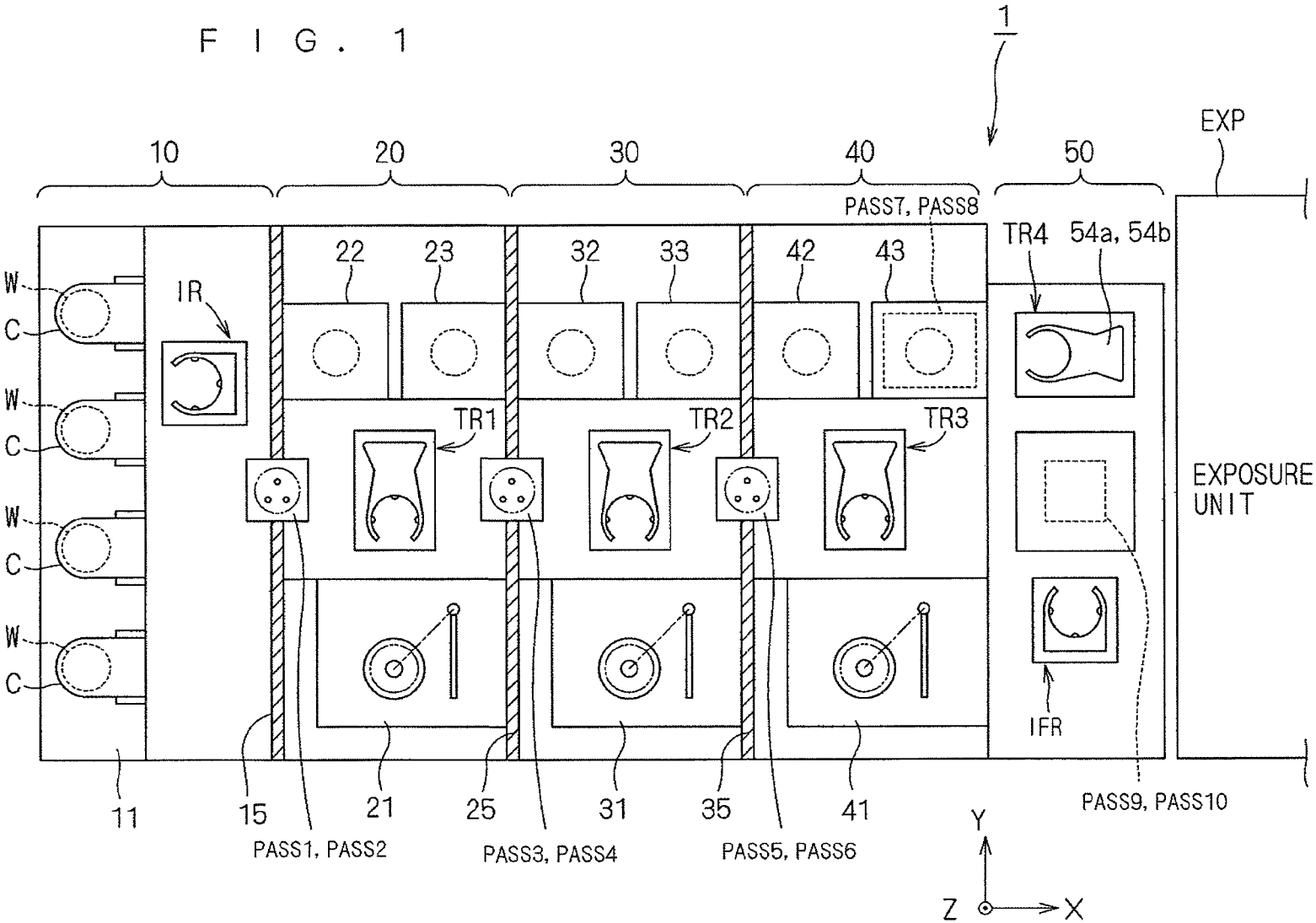
FIG. 1 is a plan view of a substrate processing apparatus with a heat treatment apparatus incorporated therein according to the present invention.
Figure 2:
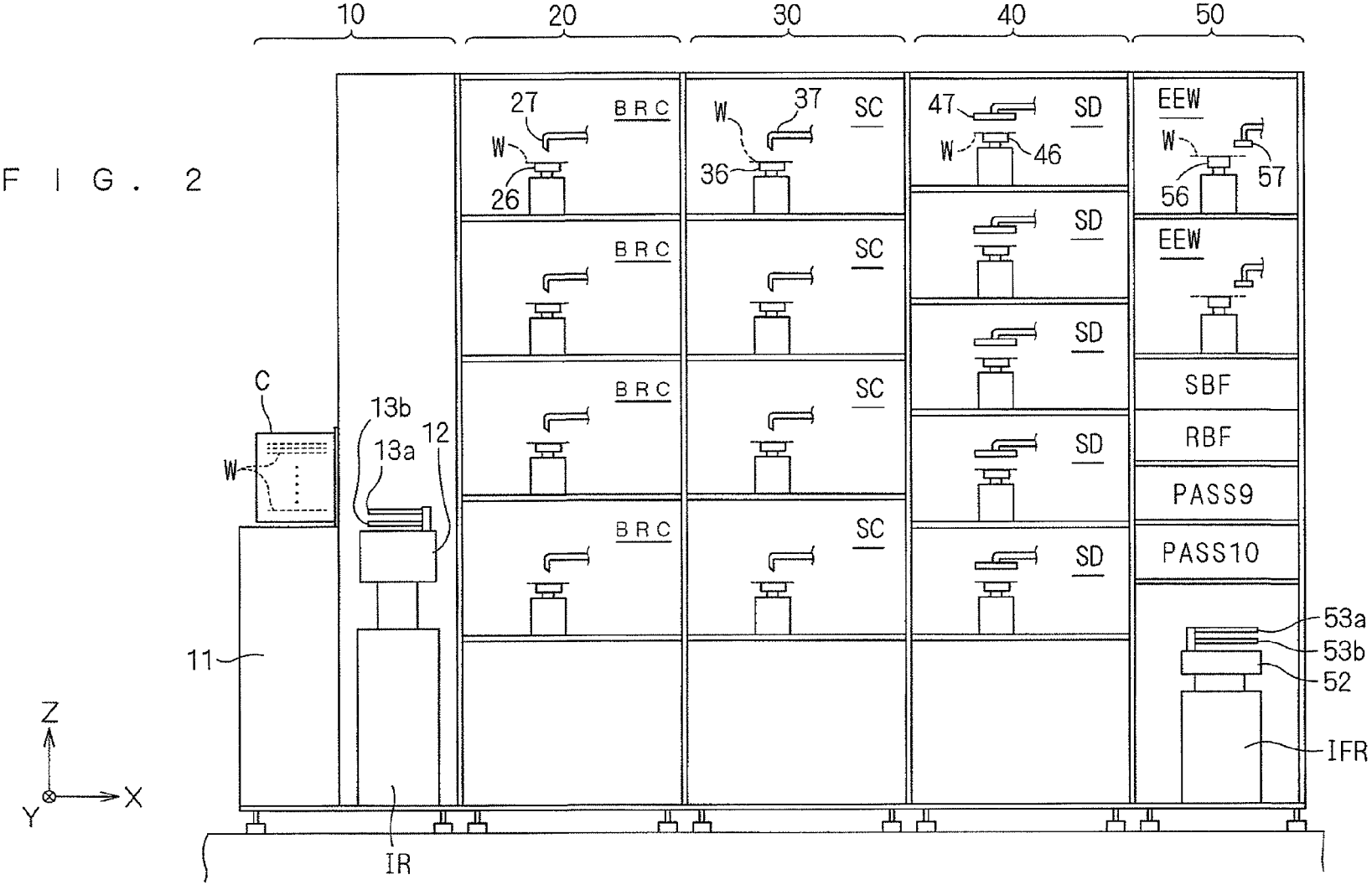
FIG. 2 is a front view of a liquid processing part in the substrate processing apparatus of FIG. 1.
Figure 4:
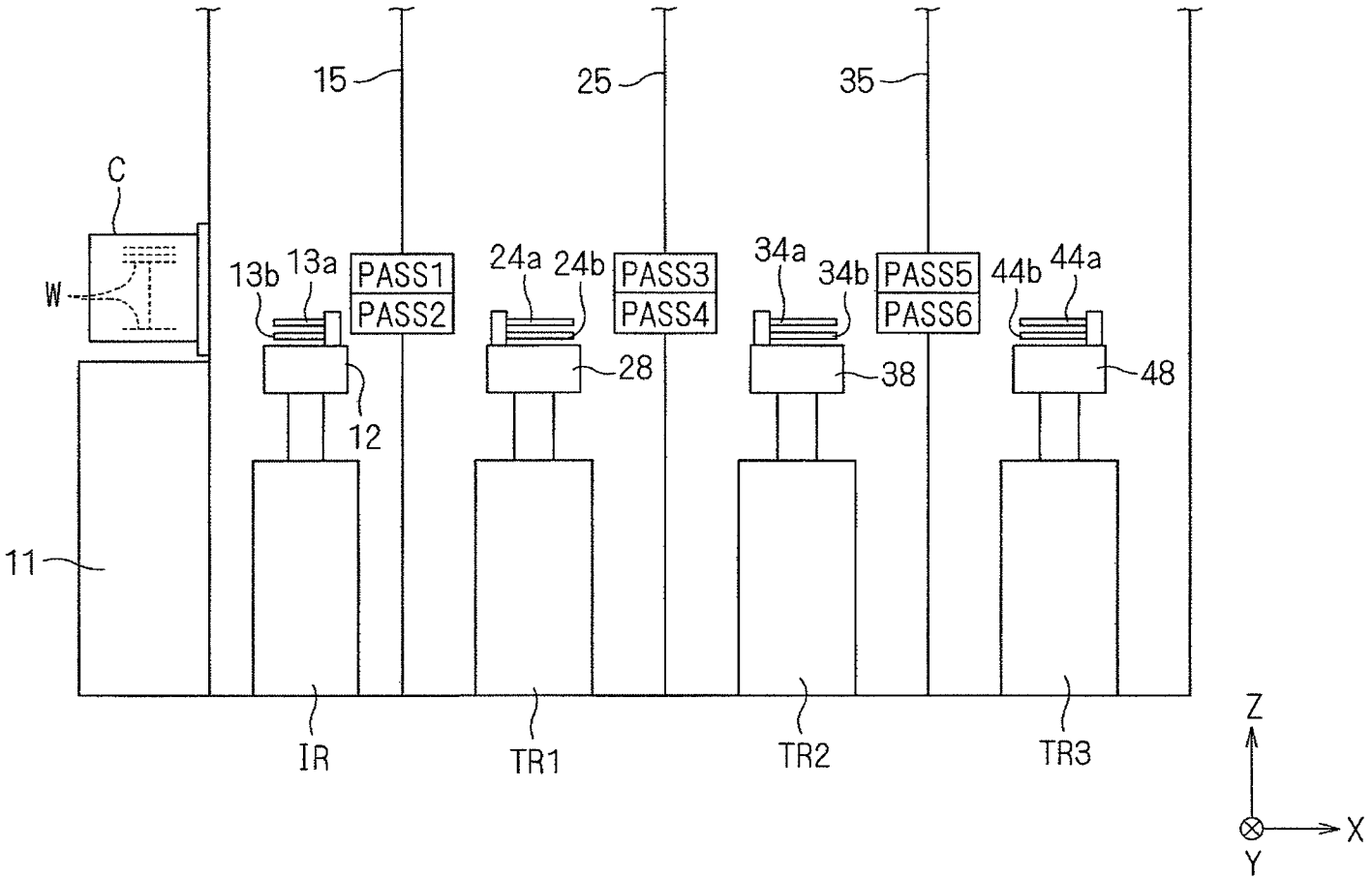
FIG. 4 is a view showing an arrangement of transport robots and substrate rest parts in the substrate processing apparatus of FIG. 1.

First, the overall construction of a substrate processing apparatus with a heat treatment apparatus incorporated therein according to the present invention will be described. FIG. 1 is a plan view of a substrate processing apparatus 1 with a heat treatment apparatus incorporated therein according to the present invention. FIG. 2 is a front view of a liquid processing part in the substrate processing apparatus 1. FIG. 3 is a front view of a heat treatment part in the substrate processing apparatus 1. FIG. 4 is a view showing an arrangement of transport robots and substrate rest parts in the substrate processing apparatus 1. An XYZ rectangular coordinate system in which an XY plane is defined as the horizontal plane and a Z axis is defined to extend in the vertical direction is additionally shown in FIG. 1 and the subsequent figures for purposes of clarifying the directional relationship therebetween. Also, the dimensions of components and the number of components are shown in exaggeration or in simplified form, as appropriate, in FIG. 1 and the subsequent figures for the sake of easier understanding.

The substrate processing apparatus 1 according to a first preferred embodiment of the present invention is an apparatus (what is called a coater-and-developer) for forming a photoresist film on substrates W such as semiconductor wafers by coating and for performing a development process on substrates W subjected to a pattern exposure process. The substrates W to be processed by the substrate processing apparatus 1 according to the present invention are not limited to semiconductor wafers, but may include glass substrates for liquid crystal display devices, glass substrates for photomasks, and the like.

The substrate processing apparatus 1 according to the first preferred embodiment includes an indexer block 10, a BARC (bottom anti-reflective coating) block 20, a resist coating block 30, a development processing block 40, and an interface block 50. In the substrate processing apparatus 1, the five processing blocks 10, 20, 30, 40 and 50 are disposed in series in one direction (in the X direction). An exposure unit (or stepper) EXP which is an external apparatus separate from the substrate processing apparatus 1 is provided and connected to the interface block 50.

The indexer block 10 is a processing block for transporting unprocessed substrates W received from the outside of the substrate processing apparatus 1 into the substrate processing apparatus 1, and for transporting processed substrates W subjected to the development process to the outside of the substrate processing apparatus 1. The indexer block 10 includes a table 11 for placing thereon a plurality of (in this preferred embodiment, four) cassettes (or carriers) C in juxtaposition, and an indexer robot IR for taking an unprocessed substrate W out of each of the cassettes C and for storing a processed substrate W into each of the cassettes C.

The indexer robot IR includes a movable base 12 movable horizontally (in the Y direction) along the table 11, movable upwardly and downwardly (in the Z direction), and rotatable about a vertical axis. Two holding arms 13*a* and 13*b* each for holding a substrate W in a horizontal position are mounted on the movable base 12. The holding arms 13*a* and 13*b* are slidable forwardly and backwardly independently of each other. Thus, each of the holding arms 13*a* and 13*b* moves horizontally in the Y direction, moves upwardly and downwardly, pivots within a horizontal plane, and moves back and forth in the direction of the pivot radius. The indexer robot IR is therefore capable of causing the holding arms 13*a* and 13*b* to individually gain access to each of the cassettes C, thereby taking an unprocessed substrate W out of each cassette C and storing a processed substrate W into each cassette C. The cassettes C may be of the following types: an SMIF (standard mechanical interface) pod, and an OC (open cassette) which exposes stored substrates W to the outside atmosphere, in addition to a FOUP (front opening unified pod) which stores substrates W in an enclosed or sealed space.

The BARC block 20 is provided in adjacent relation to the indexer block 10. A partition 15 for closing off the communication of atmosphere is provided between the indexer block 10 and the BARC block 20. The partition 15 is provided with a pair of vertically arranged substrate rest parts PASS1 and PASS2 each for placing a substrate W thereon for the transfer of the substrate W between the indexer block 10 and the BARC block 20.

The upper substrate rest part PASS1 is used for the transport of a substrate W from the indexer block 10 to the BARC block 20. The substrate rest part PASS1 includes three support pins. The indexer robot IR in the indexer block 10 places an unprocessed substrate W taken out of one of the cassettes C onto the three support pins of the substrate rest part PASS1. A transport robot TR1 provided in the BARC block 20 which will be described later receives the substrate W placed on the substrate rest part PASS1. The lower substrate rest part PASS2, on the other hand, is used for the transport of a substrate W from the BARC block 20 to the indexer block 10. The substrate rest part PASS2 also includes three support pins. The transport robot TR1 in the BARC block 20 places a processed substrate W onto the three support pins of the substrate rest part PASS2. The indexer robot IR receives the substrate W placed on the substrate rest part PASS2 and stores the substrate W into one of the cassettes C. Pairs of substrate rest parts PASS3 to PASS10 to be described later are similar in construction to the pair of substrate rest parts PASS1 and PASS2.

The substrate rest parts PASS1 and PASS2 extend through the partition 15. Each of the substrate rest parts PASS1 and PASS2 includes an optical sensor (not shown) for detecting the presence or absence of a substrate W thereon. Based on a detection signal from each of the sensors, a judgment is made as to whether or not the indexer robot IR and the transport robot TR1 stand ready to transfer and receive a substrate W to and from the substrate rest parts PASS1 and PASS2.

Next, the BARC block 20 will be described. The BARC block 20 is a processing block for forming an anti-reflective film by coating at the bottom of a photoresist film (i.e., as an undercoating film for the photoresist film) to reduce standing waves or halation occurring during exposure. The BARC block 20 includes a bottom coating processor 21 for coating a surface of a substrate W with the anti-reflective film, a pair of heat treatment towers 22 and 23 for performing a heat treatment which accompanies the formation of the anti-reflective film by coating, and the transport robot TR1 for transferring and receiving a substrate W to and from the bottom coating processor 21 and the pair of heat treatment towers 22 and 23.

In the BARC block 20, the bottom coating processor 21 and the pair of heat treatment towers 22 and 23 are arranged on opposite sides of the transport robot TR1. Specifically, the bottom coating processor 21 is on the front side (on the (−Y) side) of the substrate processing apparatus 1, and the two heat treatment towers 22 and 23 are on the rear side (on the (+Y) side) thereof. Additionally, a thermal barrier not shown is provided on the front side of the pair of heat treatment towers 22 and 23. Thus, the thermal effect of the pair of heat treatment towers 22 and 23 upon the bottom coating processor 21 is avoided by spacing the bottom coating processor 21 apart from the pair of heat treatment towers 22 and 23 and by providing the thermal barrier.

As shown in FIG. 2, the bottom coating processor 21 includes four coating processing units BRC similar in construction to each other and arranged in vertically stacked relation. Each of the coating processing units BRC includes a spin chuck 26 for rotating a substrate W in a substantially horizontal plane while holding the substrate W in a substantially horizontal position under suction, a coating nozzle 27 for applying a coating solution for the anti-reflective film onto the substrate W held on the spin chuck 26, a spin motor (not shown) for rotatably driving the spin chuck 26, a cup (not shown) surrounding the substrate W held on the spin chuck 26, and the like.

As shown in FIG. 3, the heat treatment tower 22 includes two heating units HP for heating a substrate W up to a predetermined temperature, two cooling units CP for cooling a heated substrate W down to a predetermined temperature and maintaining the substrate W at the predetermined temperature, and three adhesion promotion processing units AHL for heat-treating a substrate W in a vapor atmosphere of HMDS (hexamethyldisilazane) to promote the adhesion of the resist film to the substrate W. The two heating units HP, the two cooling units CP, and the three adhesion promotion processing units AHL are arranged in vertically stacked relation in the heat treatment tower 22. The heat treatment tower 23, on the other hand, includes two heating units HP and two cooling units CP which are arranged in vertically stacked relation. Each of the heating units HP and the adhesion promotion processing units AHL includes a hot plate for heating a substrate W by placing the substrate W thereon. Each of the cooling units CP includes a cooling plate for cooling a substrate W by placing the substrate thereon. The locations indicated by the cross marks (x) in FIG. 3 are occupied by a piping and wiring section or reserved as empty space for future addition of processing units (the same applies to other heat treatment towers which will be described later).

As shown in FIG. 4, the transport robot TR1 includes two (upper and lower) transport arms 24*a* and 24*b* in proximity to each other for holding a substrate W in a substantially horizontal position. Each of the transport arms 24*a* and 24*b* includes a distal end portion of a substantially C-shaped plan configuration, and a plurality of pins projecting inwardly from the inside of the substantially C-shaped distal end portion for supporting the peripheral edge of a substrate W from below. The transport arms 24*a* and 24*b* are mounted on a transport head 28. The transport head 28 is upwardly and downwardly movable in a vertical direction (in the Z direction), and rotatable about a vertical axis by a drive mechanism not shown. Also, the transport head 28 is capable of moving the transport arms 24*a* and 24*b* back and forth in a horizontal direction independently of each other by means of a slide mechanism not shown. Thus, each of the transport arms 24*a* and 24*b* moves upwardly and downwardly, pivots within a horizontal plane, and moves back and forth in the direction of the pivot radius. The transport robot TR1 is therefore capable of causing each of the two transport arms 24*a* and 24*b* to independently gain access to the substrate rest parts PASS1 and PASS2, the heat treatment units (the heating units HP, the cooling units CP, and the adhesion promotion processing units AHL) provided in the heat treatment towers 22 and 23, the four coating processing units BRC provided in the bottom coating processor 21, and the substrate rest parts PASS3 and PASS4 to be described later, thereby transferring and receiving substrates W to and from the aforementioned parts and units.

Next, the resist coating block 30 will be described. The resist coating block 30 is provided so as to be sandwiched between the BARC block 20 and the development processing block 40. A partition 25 for closing off the communication of atmosphere is also provided between the resist coating block 30 and the BARC block 20. The partition 25 is provided with the pair of vertically arranged substrate rest parts PASS3 and PASS4 each for placing a substrate W thereon for the transfer of the substrate W between the BARC block 20 and the resist coating block 30. The substrate rest parts PASS3 and PASS4 are similar in construction to the above-mentioned substrate rest parts PASS1 and PASS2.

The upper substrate rest part PASS3 is used for the transport of a substrate W from the BARC block 20 to the resist coating block 30. Specifically, a transport robot TR2 provided in the resist coating block 30 receives the substrate W placed on the substrate rest part PASS3 by the transport robot TR1 in the BARC block 20. The lower substrate rest part PASS4, on the other hand, is used for the transport of a substrate W from the resist coating block 30 to the BARC block 20. Specifically, the transport robot TR1 in the BARC block 20 receives the substrate W placed on the substrate rest part PASS4 by the transport robot TR2 in the resist coating block 30.

The substrate rest parts PASS3 and PASS4 extend through the partition 25. Each of the substrate rest parts PASS3 and PASS4 includes an optical sensor (not shown) for detecting the presence or absence of a substrate W thereon. Based on a detection signal from each of the sensors, a judgment is made as to whether or not the transport robots TR1 and TR2 stand ready to transfer and receive a substrate W to and from the substrate rest parts PASS3 and PASS4.

The resist coating block 30 is a processing block for applying a photoresist onto a substrate W coated with the anti-reflective film to form a resist film. In this preferred embodiment, a chemically amplified resist is used as the photoresist. The resist coating block 30 includes a resist coating processor 31 for forming a resist film by coating on the anti-reflective film serving as the undercoating film, a pair of heat treatment towers 32 and 33 for performing a heat treatment which accompanies the resist coating process, and the transport robot TR2 for transferring and receiving a substrate W to and from the resist coating processor 31 and the pair of heat treatment towers 32 and 33.

In the resist coating block 30, the resist coating processor 31 and the pair of heat treatment towers 32 and 33 are arranged on opposite sides of the transport robot TR2. Specifically, the resist coating processor 31 is on the front side of the substrate processing apparatus 1, and the two heat treatment towers 32 and 33 are on the rear side thereof. Additionally, a thermal barrier not shown is provided on the front side of the pair of heat treatment towers 32 and 33. Thus, the thermal effect of the pair of heat treatment towers 32 and 33 upon the resist coating processor 31 is avoided by spacing the resist coating processor 31 apart from the pair of heat treatment towers 32 and 33 and by providing the thermal barrier.

As shown in FIG. 2, the resist coating processor 31 includes four coating processing units SC similar in construction to each other and arranged in vertically stacked relation. Each of the coating processing units SC includes a spin chuck 36 for rotating a substrate W in a substantially horizontal plane while holding the substrate W in a substantially horizontal position under suction, a coating nozzle 37 for applying a coating solution for the photoresist onto the substrate W held on the spin chuck 36, a spin motor (not shown) for rotatably driving the spin chuck 36, a cup (not shown) surrounding the substrate W held on the spin chuck 36, and the like.

As shown in FIG. 3, the heat treatment tower 32 includes two heating units HP each including a hot plate for heating a substrate W up to a predetermined temperature, and two cooling units CP each including a cooling plate for cooling a heated substrate W down to a predetermined temperature and maintaining the substrate W at the predetermined temperature. The two heating units HP and the two cooling units CP are arranged in vertically stacked relation in the heat treatment tower 32. The heat treatment tower 32 further includes a flash bake unit FLB for irradiating a substrate W with flashes of light to momentarily heat the substrate W. The flash bake unit FLB will be described further later. The heat treatment tower 33, on the other hand, also includes two heating units HP and two cooling units CP which are arranged in vertically stacked relation.

As shown in FIG. 4, the transport robot TR2 is similar in construction to the transport robot TR1, and includes two (upper and lower) transport arms 34*a* and 34*b* in proximity to each other for holding a substrate W in a substantially horizontal position. Each of the transport arms 34*a* and 34*b* includes a plurality of pins projecting inwardly from the inside of a C-shaped arm portion for supporting the peripheral edge of a substrate W from below. The transport arms 34*a* and 34*b* are mounted on a transport head 38. The transport head 38 is upwardly and downwardly movable in a vertical direction (in the Z direction), and rotatable about a vertical axis by a drive mechanism not shown. Also, the transport head 38 is capable of moving the transport arms 34*a* and 34*b* back and forth in a horizontal direction independently of each other by means of a slide mechanism not shown. Thus, each of the transport arms 34*a* and 34*b* moves upwardly and downwardly, pivots within a horizontal plane, and moves back and forth in the direction of the pivot radius. The transport robot TR2 is therefore capable of causing each of the two transport arms 34*a* and 34*b* to independently gain access to the substrate rest parts PASS3 and PASS4, the heat treatment units provided in the heat treatment towers 32 and 33, the four coating processing units SC provided in the resist coating processor 31, and the substrate rest parts PASS5 and PASS6 to be described later, thereby transferring and receiving substrates W to and from the aforementioned parts and units.

Next, the development processing block 40 will be described. The development processing block 40 is provided so as to be sandwiched between the resist coating block 30 and the interface block 50. A partition 35 for closing off the communication of atmosphere is also provided between the development processing block 40 and the resist coating block 30. The partition 35 is provided with the pair of vertically arranged substrate rest parts PASS5 and PASS6 each for placing a substrate W thereon for the transfer of the substrate W between the resist coating block 30 and the development processing block 40. The substrate rest parts PASS5 and PASS6 are similar in construction to the above-mentioned substrate rest parts PASS1 and PASS2.

The upper substrate rest part PASS5 is used for the transport of a substrate W from the resist coating block 30 to the development processing block 40. Specifically, a transport robot TR3 provided in the development processing block 40 receives the substrate W placed on the substrate rest part PASS5 by the transport robot TR2 in the resist coating block 30. The lower substrate rest part PASS6, on the other hand, is used for the transport of a substrate W from the development processing block 40 to the resist coating block 30. Specifically, the transport robot TR2 in the resist coating block 30 receives the substrate W placed on the substrate rest part PASS6 by the transport robot TR3 in the development processing block 40.

The substrate rest parts PASS5 and PASS6 extend through the partition 35. Each of the substrate rest parts PASS5 and PASS6 includes an optical sensor (not shown) for detecting the presence or absence of a substrate W thereon. Based on a detection signal from each of the sensors, a judgment is made as to whether or not the transport robots TR2 and TR3 stand ready to transfer and receive a substrate W to and from the substrate rest parts PASS5 and PASS6.

The development processing block 40 is a processing block for performing a development process on a substrate W subjected to an exposure process. The development processing block 40 includes a development processor 41 for applying a developing solution onto a substrate W exposed in a pattern to perform the development process, a heat treatment tower 42 for performing a heat treatment subsequent to the development process, a heat treatment tower 43 for performing a heat treatment on a just-exposed substrate W, and the transport robot TR3 for transferring and receiving a substrate W to and from the development processor 41 and the heat treatment tower 42.

As shown in FIG. 2, the development processor 41 includes five development processing units SD similar in construction to each other and arranged in vertically stacked relation. Each of the development processing units SD includes a spin chuck 46 for rotating a substrate W in a substantially horizontal plane while holding the substrate W in a substantially horizontal position under suction, a nozzle 47 for applying the developing solution onto the substrate W held on the spin chuck 46, a spin motor (not shown) for rotatably driving the spin chuck 46, a cup (not shown) surrounding the substrate W held on the spin chuck 46, and the like.

As shown in FIG. 3, the heat treatment tower 42 includes two heating units HP each including a hot plate for heating a substrate W up to a predetermined temperature, and two cooling units CP each including a cooling plate for cooling a heated substrate W down to a predetermined temperature and for maintaining the substrate W at the predetermined temperature. The two heating units HP and the two cooling units CP are arranged in vertically stacked relation in the heat treatment tower 42. The heat treatment tower 43, on the other hand, also includes two heating units HP and two cooling units CP which are arranged in vertically stacked relation. The heating units HP in the heat treatment tower 43 perform a post-exposure bake (PEB) process on a just-exposed substrate W. A transport robot TR4 provided in the interface block 50 transports a substrate W into and out of the heating units HP and the cooling units CP provided in the heat treatment tower 43.

The two vertically arranged substrate rest parts PASS7 and PASS8 in proximity to each other for the transfer of a substrate W between the development processing block 40 and the interface block 50 are incorporated in the heat treatment tower 43. The upper substrate rest part PASS7 is used for the transport of a substrate W from the development processing block 40 to the interface block 50. Specifically, the transport robot TR4 provided in the interface block 50 receives the substrate W placed on the substrate rest part PASS7 by the transport robot TR3 in the development processing block 40. The lower substrate rest part PASS8, on the other hand, is used for the transport of a substrate W from the interface block 50 to the development processing block 40. Specifically, the transport robot TR3 in the development processing block 40 receives the substrate W placed on the substrate rest part PASS8 by the transport robot TR4 in the interface block 50. Each of the substrate rest parts PASS7 and PASS8 includes both an open side facing the transport robot TR3 in the development processing block 40 and an open side facing the transport robot TR4 in the interface block 50.

As shown in FIG. 4, the transport robot TR3 includes two (upper and lower) transport arms 44*a* and 44*b* in proximity to each other for holding a substrate W in a substantially horizontal position. Each of the transport arms 44*a* and 44*b* includes a plurality of pins projecting inwardly from the inside of a C-shaped arm portion for supporting the peripheral edge of a substrate W from below. The transport arms 44*a* and 44*b* are mounted on a transport head 48. The transport head 48 is upwardly and downwardly movable in a vertical direction (in the Z direction), and rotatable about a vertical axis by a drive mechanism not shown. Also, the transport head 48 is capable of moving the transport arms 44*a* and 44*b* back and forth in a horizontal direction independently of each other by means of a slide mechanism not shown. Thus, each of the transport arms 44*a* and 44*b* moves upwardly and downwardly, pivots within a horizontal plane, and moves back and forth in the direction of the pivot radius. The transport robot TR3 is therefore capable of causing each of the two transport arms 44*a* and 44*b* to independently gain access to the substrate rest parts PASS5 and PASSE, the heat treatment units provided in the heat treatment tower 42, the five development processing units SD provided in the development processor 41, and the substrate rest parts PASS7 and PASS8 in the heat treatment tower 43, thereby transferring and receiving substrates W to and from the aforementioned parts and units.

Next, the interface block 50 will be described. The interface block 50 is a processing block provided adjacent to the development processing block 40. The interface block 50 transfers an unexposed substrate W coated with the resist film to the exposure unit EXP which is an external apparatus separate from the substrate processing apparatus 1. Also, the interface block 50 receives an exposed substrate W from the exposure unit EXP to transfer the exposed substrate W to the development processing block 40. The interface block 50 includes a transport mechanism IFR for transferring and receiving a substrate W to and from the exposure unit EXP. The interface block 50 further includes two edge exposure units EEW for exposing a peripheral edge portion of a substrate W coated with the resist film to light, and the transport robot TR4 for transferring and receiving a substrate W to and from the heat treatment tower 43 in the development processing block 40 and the edge exposure units EEW.

As shown in FIG. 2, each of the edge exposure units EEW includes a spin chuck 56 for rotating a substrate W in a substantially horizontal plane while holding the substrate W in a substantially horizontal position under suction, a light irradiator 57 for exposing the peripheral edge of the substrate W held on the spin chuck 56 to light, and the like. The two edge exposure units EEW are arranged in vertically stacked relation in a central portion of the interface block 50. A send buffer SBF for the sending of substrates W, a return buffer RBF for the return of substrates W, and the pair of substrate rest parts PASS9 and PASS10 are arranged in vertically stacked relation under the edge exposure units EEW. The upper substrate rest part PASS9 is used for the transfer of a substrate W from the transport robot TR4 to the transport mechanism IFR. The lower substrate rest part PASS10 is used for the transfer of a substrate W from the transport mechanism IFR to the transport robot TR4.

The return buffer RBF is provided to temporarily store an exposed substrate W subjected to the post-exposure bake process in the heat treatment tower 43 of the development processing block 40 if the development processing block 40 is unable to perform the development process on the exposed substrate W because of some sort of malfunction and the like. The send buffer SBF, on the other hand, is provided to temporarily store an unexposed substrate W prior to the exposure process if the exposure unit EXP is unable to accept the unexposed substrate W. Each of the return buffer RBF and the send buffer SBF includes a cabinet capable of storing multiple substrates W in tiers. The transport robot TR4 gains access to the return buffer RBF, and the transport mechanism IFR gains access to the send buffer SBF.

The transport robot TR4 provided adjacent to the heat treatment tower 43 of the development processing block 40 includes two (upper and lower) transport arms 54*a* and 54*b* in proximity to each other for holding a substrate W in a substantially horizontal position, and is identical in construction and operating mechanisms with the transport robots TR1 to TR3. The transport mechanism IFR includes a movable base 52 movable horizontally in the Y direction, movable upwardly and downwardly and rotatable about a vertical axis, and two holding arms 53*a* and 53*b* mounted on the movable base 52 and each for holding a substrate W in a horizontal position. The holding arms 53*a* and 53*b* are slidable forwardly and backwardly independently of each other. Thus, each of the holding arms 53*a* and 53*b* moves horizontally in the Y direction, moves upwardly and downwardly, pivots within a horizontal plane, and moves back and forth in the direction of the pivot radius.

The exposure unit EXP receives an unexposed substrate W subjected to the resist coating process in the substrate processing apparatus 1 from the transport mechanism IFR to perform an exposure process on the substrate W. The substrate W subjected to the exposure process in the exposure unit EXP is received by the transport mechanism IFR. The exposure unit EXP may be of the type which supports what is called an "immersion exposure process" in which an exposure process is performed under such a condition that a liquid with a high refractive index (e.g., deionized water with a refractive index n of 1.44) fills a space between a projection optical system and a substrate W. Also, the exposure unit EXP may be of the type which performs an exposure process in a vacuum, such as electron beam exposure and EUV (extreme ultraviolet) exposure.

Figure 5:
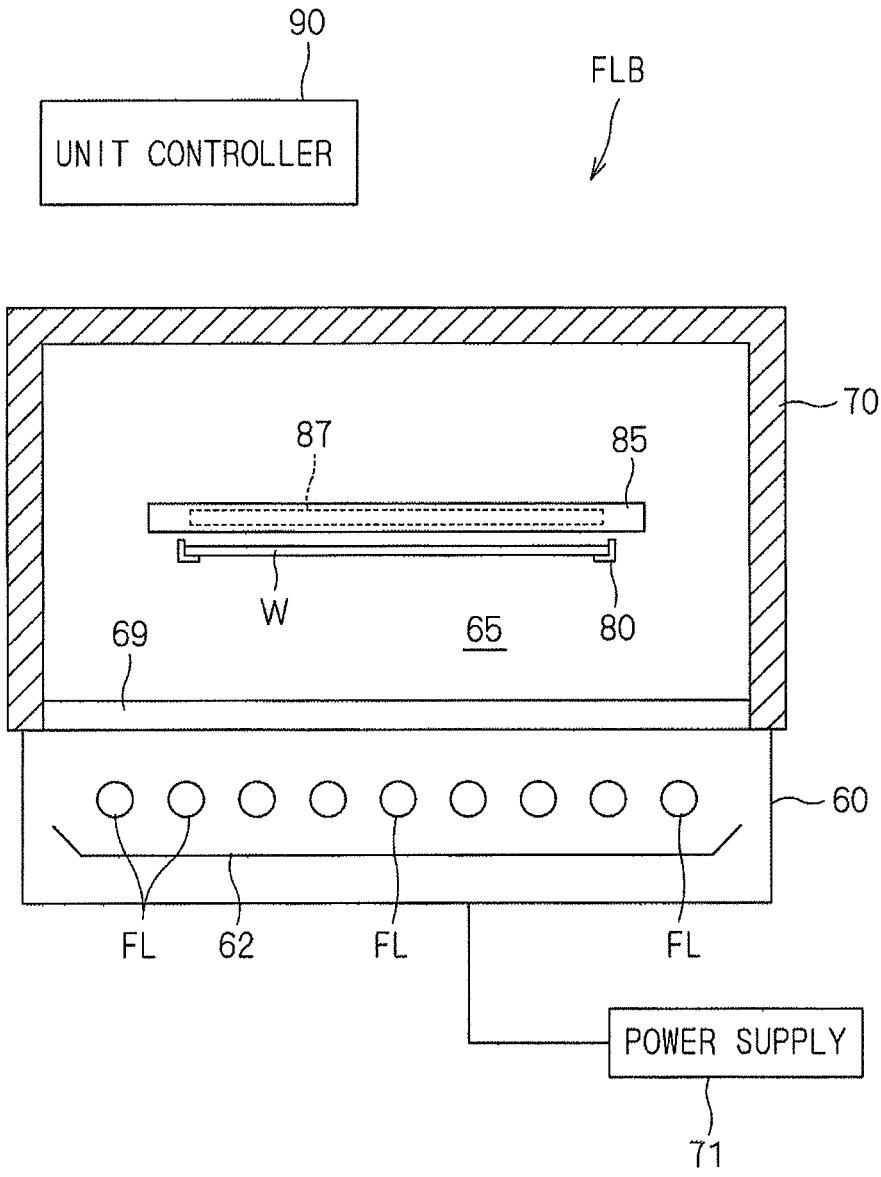
FIG. 5 is a view showing principal parts of a flash bake unit according to a first preferred embodiment of the present invention.

Next, the flash bake unit FLB provided in the heat treatment tower 32 will be described. FIG. 5 is a view showing principal parts of the flash bake unit FLB. The flash bake unit FLB is a heat treatment unit for heat-treating a substrate W having a front surface coated with a resist film to perform a post-applied bake process on the resist film.

The flash bake unit FLB includes a chamber 70 for receiving a substrate W therein, a holder 80 for holding a substrate W within the chamber 70, a cooling plate 85 disposed immediately over the holder 80, and a flash irradiation part 60 for irradiating a substrate W held by the holder 80 with flashes of light. The flash bake unit FLB further includes a unit controller 90 for controlling these components to cause the components to perform the heat treatment of the resist film.

The chamber 70 is an enclosure capable of receiving a substrate W therein. In the first preferred embodiment, the flash irradiation part 60 is provided under the chamber 70. In other words, flashes of light are directed upwardly from under the chamber 70. A chamber window 69 is mounted in the bottom opening of the chamber 70 to close the bottom opening. A space surrounded by the side walls and ceiling of the chamber 70 and the chamber window 69 is defined as a heat treatment space 65. The chamber window 69 which constitutes a floor portion of the chamber 70 is a plate-like member made of quartz, and serves as a quartz window that transmits flashes of light emitted from the flash irradiation part 60 therethrough into the heat treatment space 65.

The holder 80 includes a lug member or a collar member for supporting at least part of the peripheral portion of a substrate W from below to hold the substrate W in a horizontal position (in such a position that the normal to a main surface of the substrate W extends in a vertical direction). Since the holder 80 contacts only the peripheral portion of a substrate W, a region of the underside of the substrate W lying inside the peripheral portion is open. Thus, the holder 80 does not constitute an obstacle to the irradiation with flashes of light in the region lying inside the peripheral portion of the substrate W.

The cooling plate 85 is a generally disk-shaped member made of metal (e.g., aluminum) and incorporating cooling mechanisms 87. The cooling plate 85 is disposed in proximity to a front surface (an upper surface in the first preferred embodiment) of a substrate W held by the holder 80. A spacing between the front surface of the substrate W held by the holder 80 and the cooling plate 85 shall be not greater than 100 μm. Water cooled tubes or Peltier devices may be used as the cooling mechanisms 87. The cooling mechanisms 87 are disposed at a uniform density at least in a region opposed to the substrate W held by the holder 80. Thus, the cooling mechanisms 87 are capable of cooling the region uniformly. The cooling temperature of the cooling mechanisms 87 is under the control of the unit controller 90, and is controlled so that the cooling plate 85 maintains 23° C. which is normal room temperature in the field of semiconductor manufacturing techniques according to the first preferred embodiment.

The substrate W held in proximity to the cooling plate 85 is controlled at room temperature (23° C.) by the cooling plate 85. Specifically, when the temperature of the substrate W is higher than room temperature, the substrate W is cooled down to room temperature. When the temperature of the substrate W is near room temperature, the substrate W is maintained at room temperature with stability.

The flash irradiation part 60 is provided under the chamber 70. The flash irradiation part 60 includes a light source comprised of a plurality of flash lamps FL, and a reflector 62 provided so as to cover the bottom of the light source. The flash irradiation part 60 directs flashes of light from the flash lamps FL through the chamber window 69 made of quartz onto a substrate W held by the holder 80 within the chamber 70.

The flash lamps FL, each of which is a rod-shaped lamp having an elongated cylindrical shape, are arranged in a plane so that the longitudinal directions of the respective flash lamps FL are in parallel with each other along the main surface of a substrate W held by the holder 80 (that is, in a horizontal direction). Thus, a plane defined by the arrangement of the flash lamps FL is also a horizontal plane.

Figure 6:
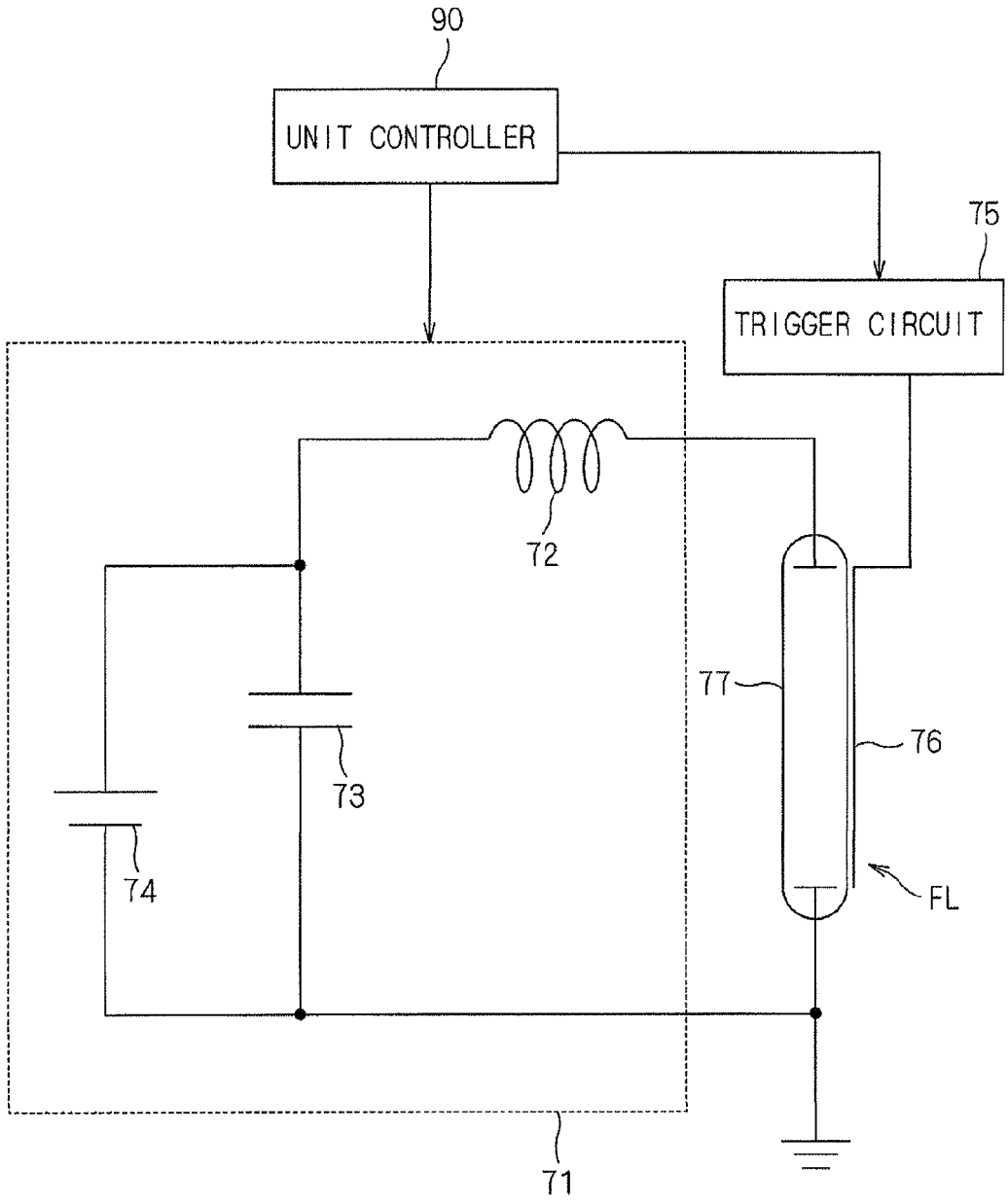
FIG. 6 is a diagram showing principal parts of a power supply unit.

A power supply unit 71 is connected to each of the flash lamps FL. FIG. 6 is a diagram showing principal parts of the power supply unit 71. The power supply unit 71 includes a coil 72, a capacitor 73, and a battery charger 74. In the first preferred embodiment, xenon flash lamps are used as the flash lamps FL. Each of the xenon flash lamps FL includes a rod-shaped glass tube (discharge tube) 77 containing xenon gas sealed therein and having positive and negative electrodes provided on opposite ends thereof, and a trigger electrode 76 mounted on the outer peripheral surface of the glass tube 77. The coil 72 and the capacitor 73 are connected in series with an interconnect line connecting the positive and negative electrodes of each flash lamp FL. The battery charger 74 applies a predetermined voltage to the capacitor 73, and the capacitor 73 is charged in accordance with the applied voltage. The value of the voltage that the battery charger 74 applies to the capacitor 73 is under the control of the unit controller 90.

A trigger circuit 75 is capable of applying a high voltage to the trigger electrode 76. The timing of the voltage application from the trigger circuit 75 to the trigger electrode 76 is under the control of the unit controller 90.

For the emission of light from each flash lamp FL, the battery charger 74 applies voltage to the capacitor 73 to charge the capacitor 73 so that the voltage takes a value specified by the unit controller 90. As the capacitor 73 is charged in accordance with the applied voltage, a potential difference is developed between the positive and negative electrodes in the glass tube 77 of each flash lamp FL. Even when such a condition is created, no current flows in the glass tube 77 in a normal state because the xenon gas is electrically insulative.

However, if a high voltage is applied from the trigger circuit 75 to the trigger electrode 76 to produce an electrical breakdown, an electrical discharge between the electrodes causes electricity stored in the capacitor 73 to flow momentarily in the glass tube 77, and xenon atoms or molecules are excited at this time to cause light emission. The xenon flash lamps FL have the property of being capable of emitting much intenser light than a light source that stays lit continuously because the electrostatic energy previously stored in the capacitor 73 is converted into an ultrashort light pulse ranging from 0.1 to 100 milliseconds. It should be noted that the waveform of current flowing in the glass tube 77 is specified by the coil 72. The higher the inductance of the coil 72 is, the longer the period of time over which current flows in the glass tube 77 (i.e., the time period for light emission) is.

Also, the reflector 62 is provided under the plurality of flash lamps FL so as to cover all of the flash lamps FL. A fundamental function of the reflector 62 is to reflect flashes of light emitted from the plurality of flash lamps FL toward the heat treatment space 65. The reflector 62 is a plate made of an aluminum alloy. A surface of the reflector 62 (a surface which faces the flash lamps FL) is roughened by abrasive blasting to produce a stain finish thereon.

The unit controller 90 controls the aforementioned various operating mechanisms provided in the flash bake unit FLB. The unit controller 90 is similar in hardware construction to typical computers. Specifically, the unit controller 90 includes a CPU for performing various computation processes, a ROM or read-only memory for storing a basic program therein, a RAM or readable/writable memory for storing various pieces of information therein, a magnetic disk for storing control applications and data therein, and the like. The CPU in the unit controller 90 executes a predetermined processing program, whereby the processes in the flash bake unit FLB proceed. The unit controller 90 may be provided as a lower-level controller that is at a level lower than that of a main controller which controls the entire substrate processing apparatus 1.

The flash bake unit FLB further includes, in addition to the components described above, a transport opening for the transport of a substrate W therethrough into and out of the chamber 70, a transfer mechanism for the transfer of a substrate W between the transport arms 34*a* and 34*b* of the transport robot TR2 and the holder 80, and an atmosphere control mechanism (a gas supply mechanism and an exhaust mechanism) for controlling the atmosphere in the heat treatment space 65 (all not shown). These components used herein may employ various known ones. For example, a combination of an elevating mechanism for the holder 80 and lift pins may be used as the transfer mechanism.

Next, a procedure for substrate processing in the substrate processing apparatus 1 having the aforementioned configuration will be described. Description will be given herein first briefly on a general procedure in the substrate processing apparatus 1, and then on the processes in the flash bake unit FLB.

Unprocessed substrates W stored in a cassette C are transported from the outside of the substrate processing apparatus 1 into the indexer block 10 by an AGV (automatic guided vehicle) and the like. Subsequently, the unprocessed substrates W are transferred outwardly from the indexer block 10. Specifically, the indexer robot IR takes an unprocessed substrate W out of a predetermined cassette C, and places the unprocessed substrate W onto the upper substrate rest part PASS1. After the unprocessed substrate W is placed on the substrate rest part PASS1, the transport robot TR1 in the BARC block 20 receives the unprocessed substrate W, and transports the unprocessed substrate W to one of the adhesion promotion processing units AHL in the heat treatment tower 22. In the adhesion promotion processing unit AHL, the substrate W is heat-treated in a vapor atmosphere of HMDS, whereby the adhesion of the substrate W is promoted. The transport robot TR1 takes the substrate W subjected to the adhesion promotion process out of the adhesion promotion processing unit AHL, and transports the substrate W to one of the cooling units CP in the heat treatment towers 22 and 23, which in turn cools down the substrate W.

The transport robot TR1 transports the cooled substrate W from the cooling unit CP to one of the coating processing units BRC in the bottom coating processor 21. In the coating processing unit BRC, the coating solution for the anti-reflective film is supplied to a front surface of the substrate W so that the front surface of the substrate W is spin-coated with the coating solution.

After the completion of the coating process, the transport robot TR1 transports the substrate W to one of the heating units HP in the heat treatment towers 22 and 23. In the heating unit HP, heating the substrate W dries the coating solution to bake the anti-reflective film serving as the undercoat on the substrate W. Thereafter, the transport robot TR1 takes the substrate W out of the heating unit HP, and transports the substrate W to one of the cooling units CP in the heat treatment towers 22 and 23, which in turn cools down the substrate W. The transport robot TR1 places the cooled substrate W onto the substrate rest part PASS3.

After the substrate W coated with the anti-reflective film is placed on the substrate rest part PASS3, the transport robot TR2 in the resist coating block 30 receives the substrate W, and transports the substrate W to one of the cooling units CP in the heat treatment towers 32 and 33, which in turn controls the substrate W at a predetermined temperature. Subsequently, the transport robot TR2 transports the temperature-controlled substrate W to one of the coating processing units SC in the resist coating processor 31. In the coating processing unit SC, the front surface of the substrate W is spin-coated with the coating solution for the photoresist, so that the resist film is formed on the front surface of the substrate W. In this preferred embodiment, a chemically amplified resist is used as the photoresist.

After the completion of the resist coating process, the transport robot TR2 transports the substrate. W out of the coating processing unit SC to the flash bake unit FLB in the heat treatment tower 32. In the flash bake unit FLB, heating the substrate W by irradiating the substrate W with flashes of light causes a solvent in the resist to evaporate, whereby the post-applied bake process is performed on the resist film, which will be described in detail later. Thereafter, the transport robot TR2 takes the substrate W out of the flash bake unit FLB, and transports the substrate W to one of the cooling units CP in the heat treatment towers 32 and 33, which in turn cools down the substrate W. Then, the transport robot TR2 places the cooled substrate W onto the substrate rest part PASS5.

After the substrate W subjected to the post-applied bake process is placed on the substrate rest part PASS5, the transport robot TR3 in the development processing block 40 receives the substrate W, and places the substrate W onto the substrate rest part PASS7 without any processing of the substrate W. Then, the transport robot TR4 in the interface block 50 receives the substrate W placed on the substrate rest part PASS1, and transports the substrate W into one of the upper and lower edge exposure units EEW. In the edge exposure unit EEW, a peripheral edge portion of the substrate W is exposed to light (an edge exposure process). The transport robot TR4 places the substrate W subjected to the edge exposure process onto the substrate rest part PASS9. The transport mechanism IFR receives the substrate W placed on the substrate rest part PASS9, and transports the substrate W into the exposure unit EXP. The substrate W transported into the exposure unit EXP is subjected to the pattern exposure process. Because the chemically amplified resist is used in the first preferred embodiment, an acid is formed by a photochemical reaction in the exposed portion of the resist film formed on the substrate W.

The exposed substrate W subjected to the pattern exposure process is transported from the exposure unit EXP back to the interface block 50 again. The transport mechanism IFR places the substrate W onto the substrate rest part PASS10. After the exposed substrate W is placed on the substrate rest part PASS10, the transport robot TR4 receives the substrate W, and transports the substrate W to one of the heating units HP in the heat treatment tower 43 of the development processing block 40. In the heating unit HP in the heat treatment tower 43, the post-exposure bake process is performed which causes a reaction such as crosslinking, deprotection or decomposition and the like of the resist resin to proceed using a product formed by the photochemical reaction during the exposure process as an acid catalyst, thereby locally changing the solubility of only the exposed portion of the resist resin in the developing solution.

The substrate W subjected to the post-exposure bake process is cooled down by a mechanism inside the heating unit HP, whereby the aforementioned chemical reaction stops. Subsequently, the transport robot TR4 takes the substrate W out of the heating unit HP in the heat treatment tower 43, and is placed onto the substrate rest part PASS8.

After the substrate W is placed on the substrate rest part PASS8, the transport robot TR3 in the development processing block 40 receives the substrate W, and transports the substrate W to one of the cooling units CP in the heat treatment tower 42. In the cooling unit CP, the substrate W subjected to the post-exposure bake process is further cooled down and precisely controlled at a predetermined temperature. Thereafter, the transport robot TR3 takes the substrate W out of the cooling unit CP, and transports the substrate W to one of the development processing units SD in the development processor 41. In the development processing unit SD, the developing solution is supplied to the substrate W to cause the development process to proceed. After the completion of the development process, the transport robot TR3 transports the substrate W to one of the heating units HP in the heat treatment tower 42. In the heating unit HP, a hard bake (HB) process is performed to completely dry the resist film. Thereafter, the transport robot TR3 takes the substrate W subjected to the hard bake process out of the heating unit HP, and transports the substrate W to one of the cooling units CP in the heat treatment tower 42, which in turn cools down the substrate W.

Thereafter, the transport robot TR3 takes the substrate W out of the cooling unit CP, and places the substrate W onto the substrate rest part PASS6. The transport robot TR2 in the resist coating block 30 places the substrate W from the substrate rest part PASS6 onto the substrate rest part PASS4 without any processing of the substrate W. Next, the transport robot TR1 in the BARC block 20 places the substrate W from the substrate rest part PASS4 onto the substrate rest part PASS2 without any processing of the substrate W, whereby the substrate W is stored in the indexer block 10. Then, the indexer robot IR stores the processed substrate W placed on the substrate rest part PASS2 into a predetermined cassette C. Thereafter, the cassette C in which a predetermined number of processed substrates W are stored is transported to the outside of the substrate processing apparatus 1. Thus, a series of photolithographic processes are completed.

Figure 7:
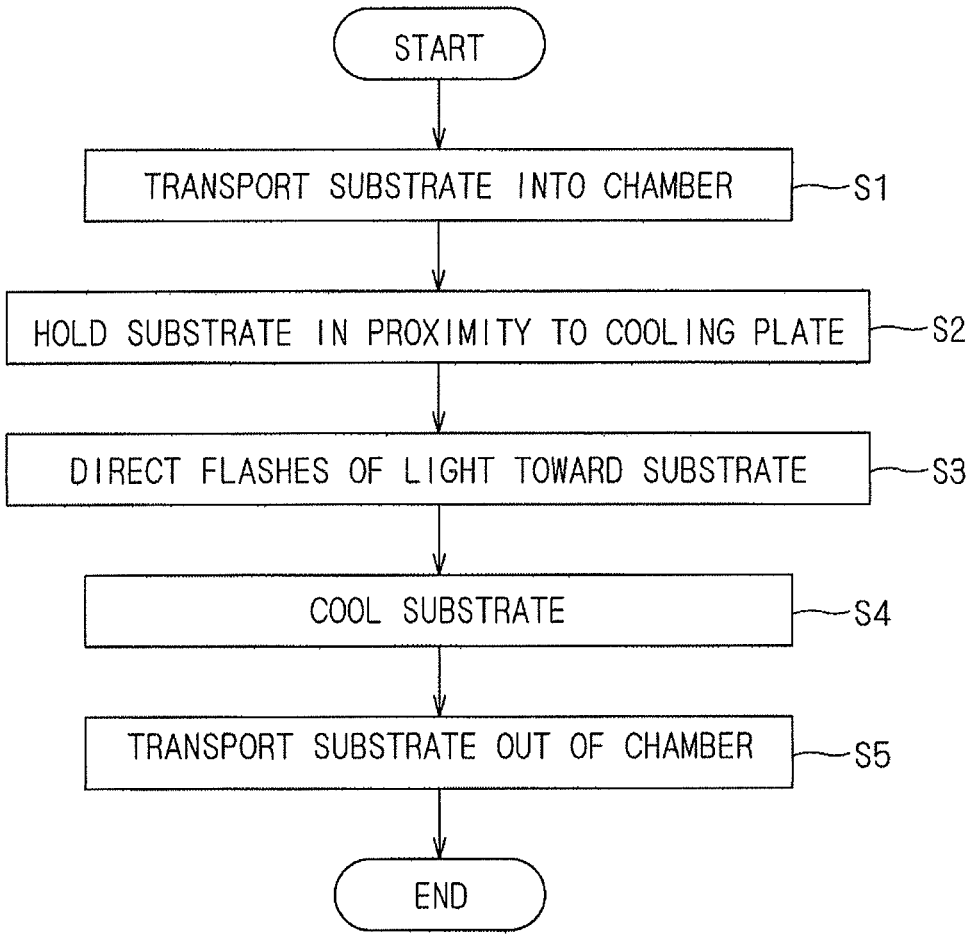
FIG. 7 is a flow diagram showing a procedure for processing a substrate in the flash bake unit.
Figure 8:
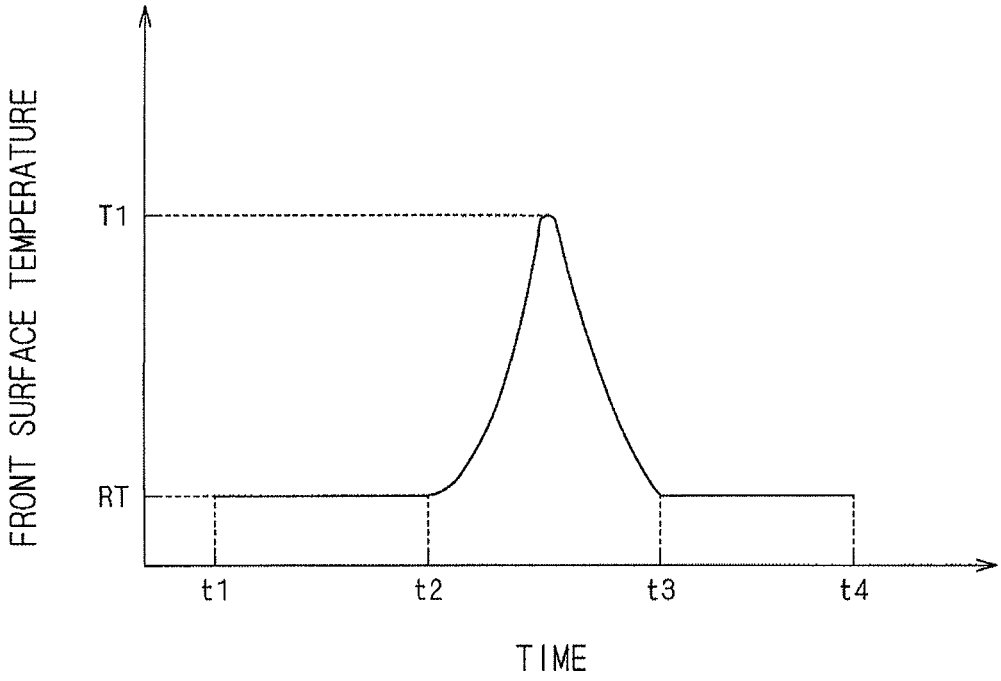
FIG. 8 is a graph showing changes in the temperature of the front surface of a substrate.

The processes in the flash bake unit FLB will be further described. FIG. 7 is a flow diagram showing a procedure for the processing of a substrate W in the flash bake unit FLB. FIG. 8 is a graph showing changes in the temperature of the front surface of a substrate W. The unit controller 90 controls the operating mechanisms in the flash bake unit FLB, whereby the procedure for the processing of a substrate W in the flash bake unit FLB proceeds.

First, the transport robot TR2 in the resist coating block 30 transports a substrate W into the chamber 70 (in Step S1). The resist film is formed on the front surface of the substrate W transported into the chamber 70 by spin-coating the front surface of the substrate W with the resist coating solution in one of the coating processing units SC. The resist film formed on the front surface of the substrate W has a thickness of not greater than 100 nm. The transport arm 34*b* (or 34*a*) of the transport robot TR2 which holds the substrate W having the front surface coated with the resist film moves forward into the chamber 70, and transfers the substrate W through a transfer mechanism not shown to the holder 80. The holder 80 holds the substrate W in a horizontal position so that the front surface of the substrate W coated with the resist film is in proximity to the cooling plate 85 (in Step S2).

Time t1 in FIG. 8 is the time at which the holder 80 holds the substrate W. The temperature of the substrate W at time t1 is equal to that of an atmosphere in which the substrate processing apparatus 1 is installed, and is approximately equal to room temperature.

The cooling plate 85 is previously controlled at room temperature (23° C.) by the cooling mechanisms 87. The unit controller 90 controls the cooling mechanisms 87 so that the cooling plate 85 is at a temperature of 23° C. The holder 80 holds the substrate W in proximity to the cooling plate 85, whereby the cooling plate 85 starts controlling the temperature of the substrate W at time t1. Thus, the substrate W is controlled precisely at a temperature of 23° C. As a result, temperature history uniformity between substrates W included in a lot is improved.

Next, flashes of light are directed from the flash lamps FL of the flash irradiation part 60 toward the substrate W held by the holder 80 at time t2 under the control of the unit controller 90 (in Step S3). More specifically, before time t2 (or before the substrate W is transported into the chamber 70), the battery charger 74 applies voltage to the capacitor 73 to charge the capacitor 73 so that the voltage takes a value specified by the unit controller 90. At time t2, the capacitor 73 is charged in accordance with the applied voltage specified by the unit controller 90, and a potential difference approximately equal to the applied voltage is developed between the positive and negative electrodes in the glass tube 77 of each flash lamp FL. Then, at time t2, the trigger circuit 75 applies a high voltage to the trigger electrode 76 under the control of the unit controller 90. This breaks down the electrical insulation of the xenon gas, so that the electrical charge stored in the capacitor 73 is discharged momentarily between the electrodes of the glass tube 77, whereby xenon atoms or molecules are excited at this time to cause light emission. The light emitted in this manner from each flash lamp FL is a flash of light, and the time period for light emission from each flash lamp FL is as extremely short as 0.1 to 100 milliseconds. It should be noted that the time period for light emission from each flash lamp FL is specified by the inductance of the coil 72. Part of the flashes of light emitted from the flash lamps FL travel directly toward the heat treatment space 65 of the chamber 70. The remainder of the flashes of light are reflected once from the reflector 62, and then travel toward the heat treatment space 65.

In the first preferred embodiment, the flash irradiation part 60 is provided under the chamber 70, and the substrate W is held by the holder 80 so that the front surface of the substrate W coated with the resist film is positioned to face upward. Thus, the flash lamps FL are opposed to the back surface of the substrate W, and the flashes of light are directed onto the back surface of the substrate W.

Figure 9:
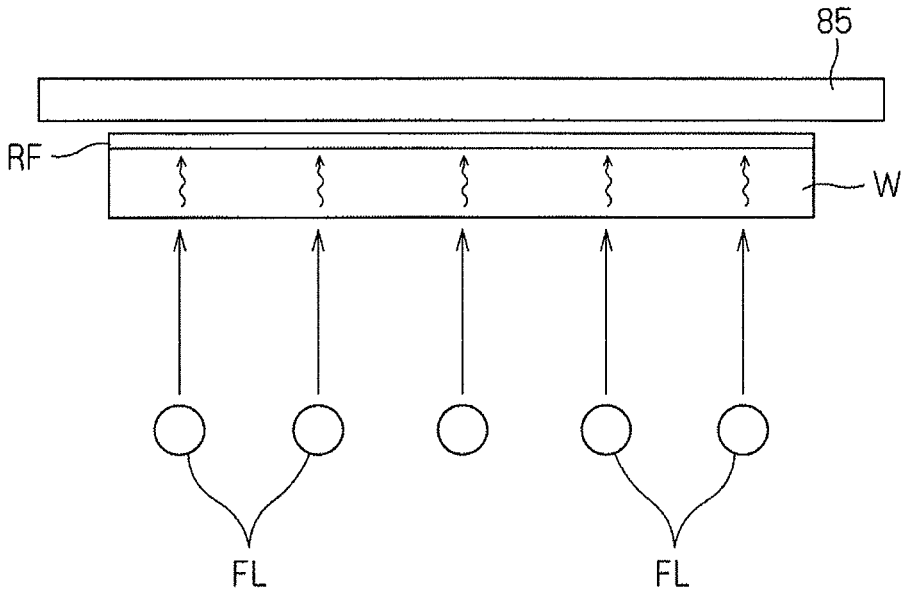
FIG. 9 is a view schematically illustrating how the front surface of a substrate is heated by flashes of light directed onto the back surface thereof according to the first preferred embodiment.

FIG. 9 is a view schematically illustrating how the front surface of a substrate W is heated by flashes of light directed onto the back surface thereof. The flashes of light emitted from the flash lamps FL are intense flashes of light emitted for an extremely short period of time ranging from about 0.1 to about 100 milliseconds because the previously stored electrostatic energy is converted into such ultrashort light pulses. The temperature of the back surface of the substrate W irradiated with flashes of light emitted from the flash lamps FL rises suddenly momentarily. Then, heat conduction from the back surface of the substrate W abruptly raised in temperature toward the front surface thereof occurs to heat a resist film RF formed on the front surface of the substrate W.

The temperature of the front surface of the substrate W suddenly rises to a treatment temperature T1 by directing flashes of light from the flash lamps FL onto the back surface of the substrate W in this manner, and thereafter falls rapidly to room temperature. The treatment temperature T1 is a temperature required to evaporate a solvent from the resist film RF, and is approximately 100° C. in the first preferred embodiment. The resist film RF formed on the front surface of the substrate W is heated to the treatment temperature T1, whereby the post-applied bake process which evaporates the solvent is performed. Since the thickness of the resist film RF is as extremely thin as 100 nm or less, the temperature of the front surface of the substrate W is approximately equal to that of the resist film RF, and the resist film RF is heated to the treatment temperature T1 across the thickness thereof.

A heating treatment time period between the time t2 at which the temperature of the resist film. RF on the front surface of the substrate W irradiated with flashes of light starts rising and the time t3 at which the temperature of the resist film RF falls to room temperature, i.e. a time period for heating treatment by the irradiation with flashes of light in a flash irradiation step, is not greater than one second. The irradiation of the substrate W with intense flashes of light from the flash lamps FL even in such a short time of not greater than one second allows the solvent to evaporate from the resist film RF, thereby accomplishing the post-applied bake process with reliability.

Even after the completion of the post-applied bake process performed on the resist film. RF by the irradiation of the back surface of the substrate W with flashes of light, the substrate W is continuously cooled and maintained at room temperature by the cooling plate 85 disposed in proximity to the substrate W (in Step S4). After a lapse of a predetermined time period, the substrate W is transferred at time t4 from the holder 80 through the transfer mechanism not shown to the transport aria 34*a* (or 34*b*) of the transport robot TR2 moved forward into the chamber 70. The transport arm 34*a* of the transport robot TR2 having received the substrate W moves backward out of the chamber 70 to transport the substrate W out of the chamber 70, whereby the post-applied bake process in the flash bake unit FLB is completed (in Step S5). It should be noted that an atmosphere in the chamber 70 during the irradiation with flashes of light may be an atmosphere of nitrogen or an atmosphere of air.

In the first preferred embodiment, the post-applied bake process is performed on the resist film formed on the front surface of the substrate W by the irradiation with flashes of light from the flash lamps FL. The time period for heating treatment by the irradiation with flashes of light is as extremely short as one second or less. In a conventional post-applied bake process in which a substrate W is placed on a hot plate and is then heated, it takes at least 30 seconds or more for the substrate W to reach a target temperature. In comparison with this, the time required for the post-applied bake process performed by the irradiation with flashes of light is extremely short. This consequently improves throughput in the substrate processing apparatus 1.

When the time required for the post-applied bake process is short, this process does not determine the rate of the entire substrate processing apparatus 1 in which only the single flash bake unit FLB is mounted. For a throughput similar to the conventional one, the number of units mounted in the substrate processing apparatus 1 is significantly reduced. This achieves a compact apparatus size, and also suppresses the increase in power consumption. Further, the post-applied bake process performed in a short time prevents oxidation of the resist film, and also suppresses nonuniformity in the amount of residual solvent resulting from an air flow in the chamber 70.

In the first preferred embodiment, the resist film formed on the front surface of the substrate W is heated by irradiating the back surface of the substrate W with flashes of light. The back surface of the substrate W is not coated with any film, but is a plain surface at which a base material of silicon is uncovered. Thus, the entire back surface of the substrate W has a uniform absorptance of flashes of light, so that the resist film formed on the front surface of the substrate W is uniformly heated. Also, the substrate W has a constant absorptance of flashes of light regardless of the type of resist film formed on the front surface of the substrate W and the type of pattern formed in the resist film. Thus, when flashes of light are emitted from the flash lamps FL under the same condition, the resist film is heated to the constant treatment temperature T1 with reliability.

In some cases, it is desired to make the treatment temperature T1 different depending on the type of resist film formed on the front surface of the substrate W. In such cases, a conventional process in which a substrate W is placed on a hot plate and is then heated has required long time to change the setting temperature of the hot plate. For example, it takes three minutes to change the setting temperature of the hot plate by 30° C., and it takes 30 to 60 seconds to change the setting temperature of the hot plate by 5° C. The time period required for the change has become waiting time. The flash bake unit FLB according to the first preferred embodiment, on the other hand, is capable of changing the intensity of flashes of light emitted from the flash lamps FL to thereby easily change the treatment temperature T1 of the resist film. This allows the process of irradiation with flashes of light to be performed on substrates W coated with different types of resist films in succession without any waiting time for treatment temperature changes. As a result, the first preferred embodiment prevents the reduction in throughput in the substrate processing apparatus 1 even when substrates W coated with different types of resist films are subjected to the post-applied bake process in succession.

The intensity of flashes of light emitted from the flash lamps FL may be changed easily, for example, by changing the charging voltage of the capacitor 73 specified by the unit controller 90 and thereby controlling the voltage applied to the flash lamps FL. In other words, the unit controller 90 specifies the charging voltage that the battery charger 74 applies to the capacitor 73 to control the voltage applied to the flash lamps FL so that the treatment temperature T1 of the resist film attained by the irradiation with flashes of light reaches a temperature suitable for the type of this resist film.

Additionally, the cooling plate 85 is disposed in proximity to the front surface of the substrate W held by the holder 80 according to the first preferred embodiment. This cooling plate 85 precisely controls the temperature of the substrate W before and after the irradiation with flashes of light at room temperature. That is, the substrate W is irradiated with flashes of light, while the cooling plate 85 cools the substrate W. This provides temperature history uniformity between substrates W to be treated in succession.

Also in the flash bake unit FLB, the cooling plate 85 precisely controls the temperature of the substrate W at room temperature after the post-applied bake process is performed by the irradiation with flashes of light. Thus, the step of transporting the substrate W to one of the cooling units CP to cool the substrate W may be dispensed with. This further improves throughput in the substrate processing apparatus 1.

<Second Preferred Embodiment>

Figure 10:
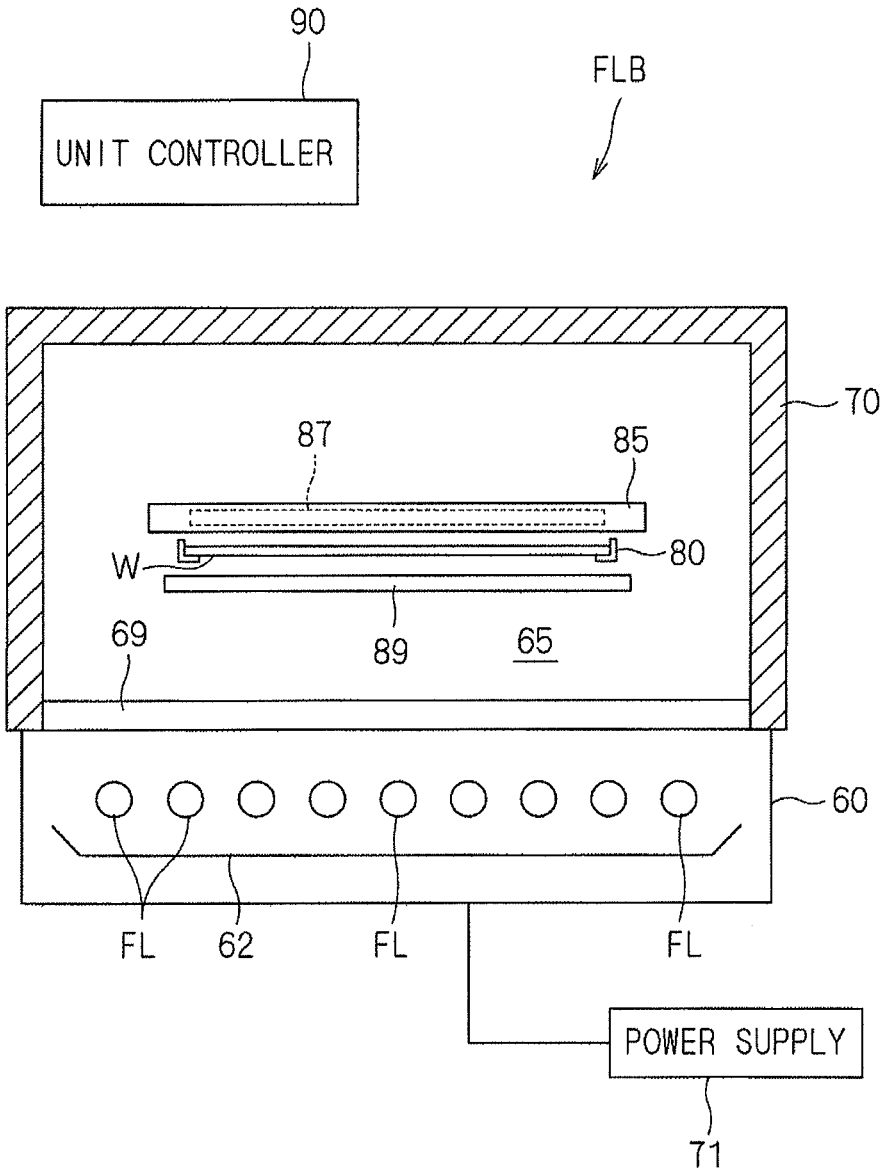
FIG. 10 is a view showing principal parts of the flash bake unit according to a second preferred embodiment of the present invention.

Next, a second preferred embodiment according to the present invention will be described. FIG. 10 is a view showing principal parts of the flash bake unit FLB according to the second preferred embodiment. Like reference numerals and characters are used to designate components in FIG. 10 identical with those of the first preferred embodiment (with reference to FIG. 5). The flash bake unit FLB according to the second preferred embodiment differs from that according to the first preferred embodiment in comprising a black body plate 89.

The black body plate 89 is made of carbon, and is provided between a substrate W held by the holder 80 and the flash lamps FL. The black body plate 89 is provided at least in a region opposed to the entire back surface of the substrate W held by the holder 80. The black body plate 89 containing black carbon as a material absorbs flashes of light emitted from the flash lamps FL. Thus, flashes of light emitted from the flash lamps FL toward the substrate W are intercepted and absorbed by the black body plate 89, and do not directly reach the substrate W. The remaining parts of the second preferred embodiment are similar to those of the first preferred embodiment.

A procedure in the substrate processing apparatus 1 and a procedure in the flash bake unit FLB according to the second preferred embodiment are also similar to those according to the first preferred embodiment. In the second preferred embodiment, however, the substrate W is heated indirectly by the irradiation with flashes of light because the black body plate 89 is provided between the substrate W and the flash lamps FL.

Figure 11:
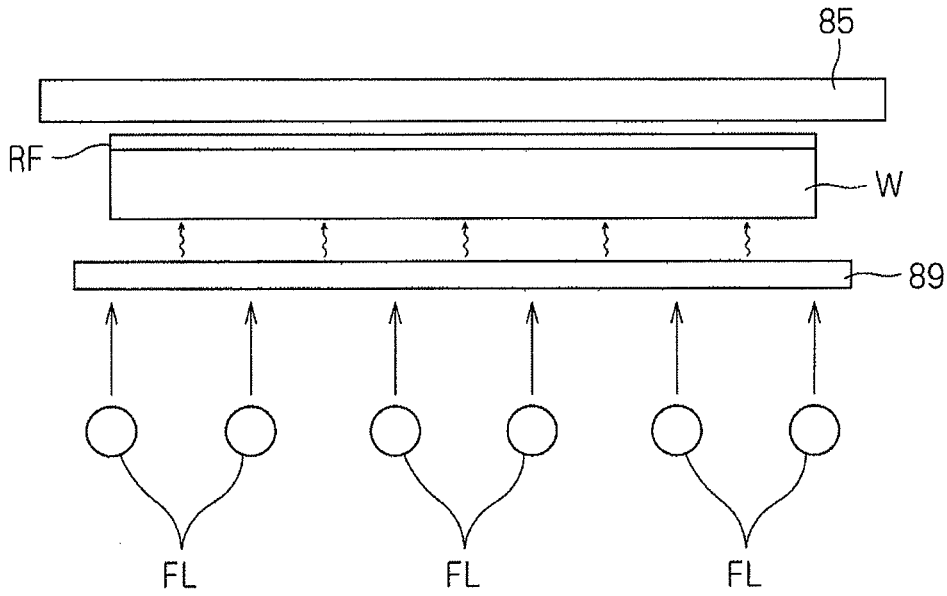
FIG. 11 is a view schematically illustrating how a substrate is heated by the irradiation with flashes of light according to the second preferred embodiment.

FIG. 11 is a view schematically illustrating how a substrate W is heated by the irradiation with flashes of light according to the second preferred embodiment. In the second preferred embodiment, flashes of light emitted from the flash lamps FL impinge directly upon the black body plate 89. The temperature of the black body plate 89 having absorbed the flashes of light rises rapidly. Then, the entire substrate W is heated by thermal radiation from the black body plate 89 raised in temperature, and the resist film RF formed on the front surface of the substrate W is accordingly heated. It should be noted that the thermal radiation is directed from the black body plate 89 toward the back surface of the substrate W in the second preferred embodiment because the black body plate 89 and the back surface of the substrate W are opposed to each other.

In this manner, the indirect heating of the substrate W through the black body plate 89 heated by the irradiation with flashes of light raises the temperature of the front surface of the substrate W to the treatment temperature T1 identical with that of the first preferred embodiment. Thus, a solvent is evaporated from the resist film RF formed on the front surface of the substrate W, whereby the post-applied bake process is performed. Also in the second preferred embodiment, a heating treatment time period between the time at which the temperature of the resist film RF starts rising and the time at which the temperature of the resist film RF falls to room temperature, i.e. a time period for heating treatment by the irradiation with flashes of light in a flash irradiation step, is not greater than one second. Thus, the time required for the post-applied bake process is extremely short. This consequently improves throughput in the substrate processing apparatus 1 as in the first preferred embodiment. The second preferred embodiment also produces the effect of easily changing the treatment temperature of the resist film without any waiting time, which is similar to the remaining effect of the first preferred embodiment.

In particular, the substrate W is indirectly heated through the black body plate 89 in the second preferred embodiment. Thus, when flashes of light are emitted from the flash lamps FL under the same condition, the resist film is heated to the constant treatment temperature T1 with reliability regardless of the type of resist film formed on the front surface of the substrate W and the type of pattern formed in the resist film.

<Third Preferred Embodiment>

Figure 12:
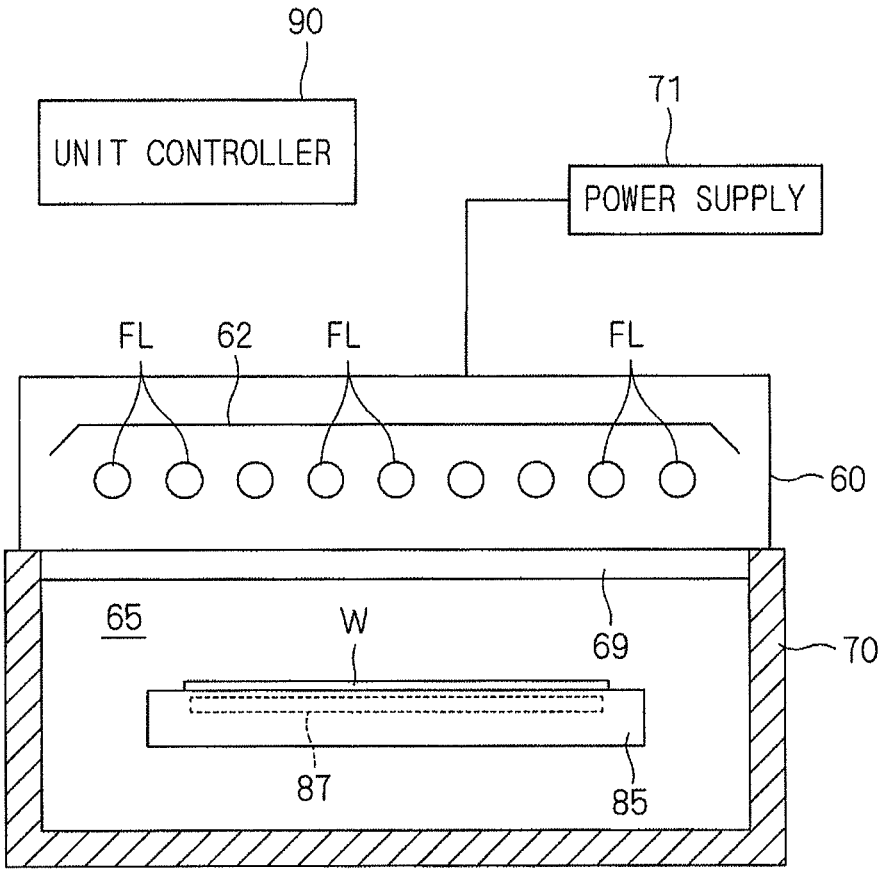
FIG. 12 is a view showing principal parts of the flash bake unit according to a third preferred embodiment of the present invention.

Next, a third preferred embodiment according to the present invention will be described. FIG. 12 is a view showing principal parts of the flash bake unit FLB according to the third preferred embodiment. Like reference numerals and characters are used to designate components in FIG. 12 identical with those of the first preferred embodiment (with reference to FIG. 5).

In the third preferred embodiment, the flash irradiation part 60 is provided over the chamber 70, and the cooling plate 85 holds a substrate W placed thereon. The chamber window 69 serving as a quartz window is mounted in the top opening of the chamber 70. A space surrounded by the side and bottom walls of the chamber 70 and the chamber window 69 is defined as the heat treatment space 65.

In the third preferred embodiment, the cooling plate 85 functions also as a holder for a substrate W. The cooling plate 85 is a generally disk-shaped member made of metal (e.g., aluminum) and incorporating the cooling mechanisms 87. The cooling plate 85 holds a substrate W in a horizontal position by placing the substrate W thereon within the chamber 70. The cooling plate 85 has a diameter greater than that of the substrate W. The cooling mechanisms 87 are disposed at a uniform density at least in a region of the cooling plate 85 opposed to the substrate W placed thereon. Thus, the cooling mechanisms 87 are capable of cooling the region uniformly. The cooling temperature of the cooling mechanisms 87 is under the control of the unit controller 90, and is controlled so that the cooling plate 85 maintains 23° C. which is normal room temperature according to the third preferred embodiment.

A support part not shown is disposed on the upper surface of the cooling plate 85. The support part is made of a material such as alumina ($Al_2O_3$), for example, and is provided in such a manner that the upper end thereof protrudes slightly from the upper surface of the cooling plate 85. Thus, a slight space of not greater than 100 μm is created between the back surface of the substrate W and the upper surface of the cooling plate 85 when the support part supports a peripheral portion of the substrate W. The substrate W placed on the cooling plate 85 through the use of the support part is controlled at room temperature (23° C.) by the cooling plate 85. Specifically, when the temperature of the substrate W is higher than room temperature, the substrate W is cooled down to room temperature. When the temperature of the substrate W is near room temperature, the temperature of the substrate W is maintained at room temperature with stability.

A transfer mechanism not shown transfers a substrate W between the transport arms 34*a* and 34*b* of the transport robot TR2 and the cooling plate 85. An example of such a transfer mechanism used herein may include a combination of lift pins extending vertically through the cooling plate 85 and an elevating mechanism for moving the lift pins upwardly and downwardly.

The flash irradiation part 60 according to the third preferred embodiment is similar in configuration to that according to the first preferred embodiment except that the flash irradiation part 60 is provided in an upside-down position over the chamber 70. The remaining parts of the third preferred embodiment are similar to those of the first preferred embodiment.

A procedure in the substrate processing apparatus 1 and a procedure in the flash bake unit FLB according to the third preferred embodiment are also substantially similar to those according to the first preferred embodiment. In the third preferred embodiment, the substrate W is placed and held in a horizontal position on the upper surface of the cooling plate 85 so that the front surface of the substrate W coated with the resist film is positioned to face upward. Thus, the front surface of the substrate W coated with the resist film is opposed to the flash lamps FL, and is irradiated with flashes of light.

The temperature of the front surface of the substrate W irradiated with flashes of light emitted from the flash lamps FL rises momentarily to the treatment temperature T1, and thereafter falls rapidly to room temperature. Such flash heating evaporates a solvent from the resist film RF formed on the front surface of the substrate W, whereby the post-applied bake process is performed. Also in the third preferred embodiment, a heating treatment time period between the time at which the temperature of the resist film RF starts rising and the time at which the temperature of the resist film RF falls to room temperature, i.e. a time period for heating treatment by the irradiation with flashes of light in a flash irradiation step, is not greater than one second. Thus, the time required for the post-applied bake process is extremely short. This consequently improves throughput in the substrate processing apparatus 1 as in the first preferred embodiment. Also, when the time required for the post-applied bake process is short, only a small number of units are required to be mounted in the substrate processing apparatus 1. This achieves a compact apparatus size, and also suppresses the increase in power consumption. Further, the post-applied bake process performed in a short time prevents oxidation of the resist film, and also suppresses nonuniformity in the amount of residual solvent resulting from an air flow in the chamber 70.

The flash bake unit FLB according to the third preferred embodiment is also capable of changing the intensity of flashes of light emitted from the flash lamps FL to thereby easily change the treatment temperature T1 of the resist film. This allows the process of irradiation with flashes of light to be performed on substrates W coated with different types of resist films in succession without any waiting time for treatment temperature changes. As a result, the third preferred embodiment prevents the reduction in throughput in the substrate processing apparatus 1 even when the substrates W coated with different types of resist films are subjected to the post-applied bake process in succession.

Also in the third preferred embodiment, the cooling plate 85 holds a substrate W placed thereon. This cooling plate 85 precisely controls the temperature of the substrate W before and after the irradiation with flashes of light at room temperature. This provides temperature history uniformity between substrates W to be treated in succession. Further, the cooling plate 85 precisely controls the temperature of the substrate W at room temperature after the post-applied bake process is performed by the irradiation with flashes of light. Thus, the step of transporting the substrate W to one of the cooling units CP to cool the substrate W may be dispensed with. This further improves throughput in the substrate processing apparatus 1.

<Modifications>

Although the preferred embodiments according to the present invention have been described hereinabove, various modifications in addition to the above may be made therein without departing from the spirit and scope of the present invention. For example, the flash bake unit FLB is provided in the heat treatment tower 32, and is adapted to perform the post-applied bake process by the irradiation with flashes of light in the preferred embodiments described above. The present invention, however, is not limited to this. Other heating treatments may be performed by the irradiation with flashes of light. As an example, the flash bake unit FLB may be provided in the heat treatment tower 42 of the development processing block 40 so that the hard bake process for completely drying the resist film after the development process of a substrate W is performed by the irradiation with flashes of light. This makes the time required for the hard bake process extremely short, thereby improving throughput in the substrate processing apparatus 1.

Alternatively, the flash bake unit FLB may be provided in the heat treatment tower 43 of the development processing block 40 so that the post-exposure bake process subsequent to the pattern exposure process is performed by the irradiation with flashes of light. This makes the time required for the post-exposure bake process extremely short in a manner similar to that described above, thereby improving throughput in the substrate processing apparatus 1. Also, the post-exposure bake process performed in a short time significantly reduces the diffusion length of acid, as compared with the conventional process. This consequently improves the LER (line edge roughness) and line width uniformity of a pattern formed in the resist film.

The film formed on the front surface of a substrate W is not limited to the resist film, but may be an interlayer insulation film or an anti-reflective film. In fact, the technique according to the present invention is applicable to a process such that the heat treatment of a substrate W having a surface coated with a film is performed by irradiation with flashes of light.

In the third preferred embodiment, a substrate W may be inverted and held by the cooling plate 85 so that the front surface of the substrate W coated with the resist film is positioned to face downward. Even when in an upside-down position, the substrate W is supported at its peripheral edge and held in slightly spaced apart relationship with the upper surface of the cooling plate 85. For this reason, no contact occurs between the resist film and the cooling plate 85. Then, flashes of light are emitted from the flash irradiation part 60 provided over the chamber 70. Such an arrangement also allows flashes of light to impinge upon the back surface of the substrate W having the front surface coated with the resist film in a manner similar to that of the first preferred embodiment, thereby producing effects similar to those of the first preferred embodiment.

To invert a substrate W, there may be provided a mechanism for rotating the transport arms 34*a* and 34*b* in the transport robot TR2 or an inverting mechanism separate from the transport robot TR2.

In the third preferred embodiment, a black body plate similar to that of the second preferred embodiment may be provided between a substrate W and the flash lamps FL. Thermal radiation is directed from the black body plate toward the front surface of the substrate W by the irradiation with flashes of light, to heat the resist film formed on the front surface of the substrate W.

In the first preferred embodiment, a substrate W may be inverted and held by the holder 80 so that the front surface of the substrate W coated with the resist film is positioned to face downward. Such an arrangement also allows flashes of light to impinge upon the front surface of the substrate W coated with the resist film in a manner similar to that of the third preferred embodiment. Also in the second preferred embodiment, a substrate W may be inverted and held by the holder 80.

Also, the substrate processing apparatus 1 may include a plurality of flash bake units FLB. In this case, the flash bake units FLB may be used in parallel or some of the flash bake units FLB may be prepared as spare units.

In the aforementioned preferred embodiments, a change in the treatment temperature T1 during the irradiation with flashes of light is achieved by changing the charging voltage of the capacitor 73. The present invention, however, is not limited to this. Any technique for changing the intensity of flashes of light emitted from the flash lamps FL may be used. For example, a switching element such as an IGBT (insulated-gate bipolar transistor) may be provided in the interconnect line connecting the positive and negative electrodes of each flash lamp FL to control the current flowing through each flash lamp FL, thereby changing the intensity of flashes of light emitted from the flash lamps FL, so that the treatment temperature T1 is changed during the irradiation with flashes of light. Alternatively, a plurality of types of capacitors having different capacitances may be provided in the power supply unit 71, in which case the switching between these types of capacitors is done to change the intensity of flashes of light emitted from the flash lamps FL.

Moreover, the substrate W to be processed or treated by the heat treatment technique according to the present invention is not limited to a semiconductor wafer, but may be a glass substrate for use in a liquid crystal display device, and a substrate for a solar cell.

While the invention has been described in detail, the foregoing description is in all aspects illustrative and not restrictive. It is understood that numerous other modifications and variations can be devised without departing from the scope of the invention.

What is claimed is:

1. A heat treatment apparatus comprising a chamber for receiving therein a substrate, said substrate having a front surface coated with a predetermined film and a back surface;

a holding part for holding said substrate in said chamber;

a flash lamp for irradiating the back surface of said substrate held by said holding part with a flash of light; and a cooling plate disposed in proximity to the front surface of said substrate held by said holding part and configured to cool down said substrate.

2. The heat treatment apparatus according to claim 1, wherein a spacing between the front surface of said substrate held by the holding part and said cooling plate is not greater than 100 μm.

3. A heat treatment apparatus comprising a chamber for receiving therein a substrate, said substrate having a front surface coated with a predetermined film and a back surface;

a holding part for holding said substrate in said chamber;

a flash lamp for irradiating the back surface of said substrate held by said holding part with a flash of light; and a black plate provided between said substrate held by said holding part and said flash lamp.

4. A method of heat-treating a substrate having a film-coated surface, comprising the steps of:

(a) putting a substrate into a chamber to hold said substrate, said substrate having a front surface coated with a predetermined film and a back surface;

(b) irradiating the back surface of said substrate held in said chamber with a flash of light emitted from a flash lamp to heat said predetermined film; and (c) irradiating the back surface of said substrate with a flash of light while said substrate is cooled by a cooling plate disposed in proximity to the front surface of said substrate.

5. The method according to claim 4, wherein a time period for heating treatment by the irradiation with a flash of light in said step (b) is not greater than one second.

6. The method according to claim 4, wherein a voltage applied to said flash lamp is controlled, whereby a treatment temperature for said predetermined film is changed in said step (b).

7. The method according to claim 4, wherein an insulated-gate bipolar transistor controls a current flowing through said flash lamp, whereby a treatment temperature for said predetermined film is changed in said step (b).

8. A method of heat-treating a substrate having a film-coated surface, comprising the steps of:

(a) putting a substrate into a chamber to hold said substrate, said substrate having a front surface coated with a predetermined film and a back surface;

(b) irradiating the back surface of said substrate held in said chamber with a flash of light emitted from a flash lamp to heat said predetermined film; and (c) a flash of light is directed onto a black plate provided between said substrate and said flash lamp to raise the temperature of said black plate, whereby said substrate is heated by thermal radiation from said black plate raised in temperature.

* * * * *